US008066100B2

(12) United States Patent
Mori et al.

(10) Patent No.: US 8,066,100 B2
(45) Date of Patent: Nov. 29, 2011

(54) OIL PAN AND LUBRICATING DEVICE

(75) Inventors: Taiichi Mori, Susono (JP); Hideo Kobayashi, Mishima (JP); Katuhiko Arisawa, Gotenba (JP); Kenichi Yamada, Yaizu (JP); Yoshio Yamashita, Susono (JP); Kunihiko Hayashi, Ashigarakami-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 891 days.

(21) Appl. No.: 11/664,601

(22) PCT Filed: Oct. 5, 2005

(86) PCT No.: PCT/JP2005/018736

§ 371 (c)(1),
(2), (4) Date: Sep. 17, 2007

(87) PCT Pub. No.: WO2006/046401

PCT Pub. Date: May 4, 2006

(65) Prior Publication Data

US 2008/0210491 A1 Sep. 4, 2008

(30) Foreign Application Priority Data

Oct. 5, 2004 (JP) ..... 2004-292556

(51) Int. Cl.
*F16N 31/00* (2006.01)

(52) U.S. Cl. ..... 184/106; 184/1.5; 184/6; 184/6.28; 184/6.3; 184/103.2; 184/104.2; 123/196 R; 123/195 C; 123/196 AB; 123/572; 123/41.86; 137/423; 137/433

(58) Field of Classification Search ..... 184/106, 184/1.5, 6.13, 6.5, 6.8, 104.2, 104.3
See application file for complete search history.

(56) References Cited

U.S. PATENT DOCUMENTS

| | | | | |
|---|---|---|---|---|
| 3,590,955 | A * | 7/1971 | Rau | 184/6 |
| 4,258,679 | A * | 3/1981 | Leitermann | 123/196 AB |
| 4,616,609 | A * | 10/1986 | Munch et al. | 123/196 AB |
| 2003/0029412 | A1 | 2/2003 | Kato et al. | |

FOREIGN PATENT DOCUMENTS

| | | |
|---|---|---|
| DE | 37 29 545 A1 | 3/1988 |
| EP | 0 936 347 A1 | 8/1999 |
| JP | A 55-54617 | 4/1980 |
| JP | A-55-054618 | 4/1980 |
| JP | U 56-169406 | 12/1981 |

(Continued)

OTHER PUBLICATIONS

Nov. 25, 2010 Search Report issued in European Patent Application No. 05793816.9.

*Primary Examiner* — Robert Siconolfi
*Assistant Examiner* — San Aung
(74) *Attorney, Agent, or Firm* — Oliff & Berridge, PLC

(57) ABSTRACT

An oil pan is provided with an oil pan separator that partitions a first chamber that communicates with a moving part inside a cylinder block and a second chamber outside the first chamber. A communicating hole is provided to a bottom panel of the oil pan separator. The communicating hole is shielded from a strainer.

4 Claims, 14 Drawing Sheets

FOREIGN PATENT DOCUMENTS

| | | |
|---|---|---|
| JP | U 57-191812 | 12/1982 |
| JP | U-59-007212 | 1/1984 |
| JP | A-60-128917 | 7/1985 |
| JP | U-3-10013 | 1/1991 |
| JP | U-5-6114 | 1/1993 |
| JP | A 6-66121 | 3/1994 |
| JP | A-07-019108 | 1/1995 |
| JP | A 2001-152825 | 6/2001 |
| JP | A 2003-222012 | 8/2003 |
| JP | A 2003-278519 | 10/2003 |
| JP | A 2005-48695 | 2/2005 |

* cited by examiner

OIL PAN AND LUBRICATING DEVICE

TECHNICAL FIELD

The present invention relates to an oil pan and a lubricating device to which the oil pan is applied.

BACKGROUND ART

For an oil pan applied to a lubricating device for lubricating a lubricated object such as an engine and an automatic transmission with lubricating oil (hereinafter merely called oil), a so-called double-tank type oil pan is well-known. The double-tank type oil pan is provided with a first chamber that communicates with the lubricated object by being opened toward the lubricated object, a second chamber that is adjacent to the first chamber and communicates with the first chamber via an oil communicating channel and a partition provided between the first chamber and the second chamber.

For related art of this type of double-tank type oil pan, a double-tank type oil pan disclosed in JP-A No. 222012/2003 can be given.

This conventional type oil pan is provided with an oil pan separator having a concave part for forming the almost whole of the volume of a first chamber (or a main chamber) inside and the inside of the oil pan is vertically partitioned into the first chamber formed by the concave part and a second chamber (or a deputy chamber) outside the first chamber by the oil pan separator. The second chamber is formed substantially overall the sides and the bottom of the first chamber (or the concave part) by providing predetermined clearance between a lower surface at the bottom of the oil pan separator and the bottom of the oil pan. In the first chamber, a strainer is arranged which is provided with an oil suction opening open to the vicinity of an inner surface of the bottom of the first chamber and connected to an oil pump for delivering oil to a lubricated object via an oil channel.

A communicating hole as the oil communicating channel which can be regulated a degree of the communication of oil between the first chamber and the second chamber according to the temperature of the oil is formed in a lower part of the side of the concave part of the oil pan separator or slightly on the upside of the bottom panel of the oil pan. That is, a diameter of the communicating hole is set to a small value of approximately 2 mm so that high temperature oil having low viscosity can easily pass though low temperature oil having high viscosity cannot easily pass.

Functions of the communicating hole are as follows. First, the viscosity of oil is high at the time before warming up is finished in cold operation (hereinafter referred as "in cold starting"). Consequently, the communication of oil between the first chamber and the second chamber via the communicating hole is limited. Accordingly, in warming up, oil is supplied from the first chamber to the lubricated object, the lubricated object is lubricated, the oil the temperature of which rises by taking heat from the lubricated object in lubrication drops into the first chamber, is collected in the first chamber, is supplied to the lubricated object again, while an inflow of low temperature oil in the second chamber into the first chamber is limited. In other words, as in warming up, only oil in the first chamber can be supplied to the lubricated object, the heat capacity (the product of specific heat and mass) of oil that can be supplied to the lubricated object is small (in other words, the whole substantial heat capacity of oil pan structure including each component of the oil pan and oil is small). Therefore, the temperature of oil to be supplied to the lubricated object is easily raised and hereby, the warming-up time of the lubricated object is reduced.

Afterward, when warming up proceeds and the temperature of oil in the first chamber rises, the temperature of oil in the second chamber also gradually rises because heat is transmitted to the oil in the second chamber via the oil pan separator. When the viscosity of the oil in the second chamber in the vicinity of the communicating hole becomes low to the extent that the oil can easily pass the communicating hole, the sufficient communication of oil between the first chamber and the second chamber via the communicating hole is enabled. In this case, the oil flows from the second chamber into the first chamber through the communicating hole by negative pressure caused in the vicinity of an oil suction opening of the strainer, and the oil flowing in from the second chamber can be supplied to the lubricated object. Hereby, as the almost whole oil inside the oil pan can be supplied to the lubricated object, the lubricated object can be satisfactorily lubricated and the heat capacity of oil that can be supplied to the lubricated object increases (in other words, the whole substantial heat capacity of the oil pan structure including each component of the oil pan and oil increases). Therefore, the excessive temperature rise of the lubricated object can be restrained.

Further, a drain hole for outpouring oil from the first chamber to the second chamber when oil is to be removed from the inside of the oil pan is formed at a lowest position of the bottom panel of the oil pan separator in addition to the communicating hole. A drain plug hole for removing oil is provided to the oil pan and oil in the second chamber which is an outermost area of the oil pan is discharged outside the oil pan by pulling out a drain plug that closes the drain plug hole and releasing the drain plug hole. Oil in the first chamber which is an inner area once flows out into the second chamber through the drain hole and then discharged outside the oil pan. In the meantime, as described above, the drain hole is formed in the lowest position of the bottom panel of the oil pan separator, in other words, in the lowest position in the first chamber. The oil suction opening of the strainer is also arranged close to the inner surface of the bottom of the first chamber as described above. Accordingly, when oil in the first chamber is sucked by the strainer in warming up, there is a concern about flowing low temperature oil in the second chamber into the first chamber through the drain hole by negative pressure caused by the strainer and diminishing the effect of the reduction of warming-up time. Accordingly, though the fact described below is not definitely described in JP-A No. 222012/2003, a diameter of the drain hole is required to be formed in size in which low temperature oil in the second chamber in warming up cannot easily pass, that is, in the similar size to the communicating hole.

DISCLOSURE OF THE INVENTION

However, the above-mentioned conventional type double-tank type oil pan has a problem that the movement of oil from the first chamber into the second chamber is slow when oil is removed from the inside of the oil pan for an oil change and the oil change is not prompt.

That is, as described above, in removing oil, oil in the first chamber is discharged outside the oil pan after the oil once flows into the second chamber located outside the first chamber. As an oil change is to be made when the operation of the lubricated object is stopped, the temperature of oil in removing is to be lower than that of which when the lubricated object is operated (or when warming up is finished). The double-tank type oil pan has the configuration that when the temperature of oil is low (as the temperature of oil before warming up is finished), the communication of oil between the first chamber and the second chamber through the communicating hole (or the oil communicating channel) is restrained as described above. Therefore, when oil is removed, it is difficult to outpour oil from the first chamber to the second chamber through the communicating hole.

In the meantime, as described above, the drain hole for removing oil is provided to the bottom of the concave part of the oil pan separator separately from an oil communicating channel. However, as described above, the size of the drain hole is too small to pass low temperature oil in the second chamber. Accordingly, when the operation of the lubricated object is stopped and oil is removed (the temperature of the oil is low), it is difficult to outpour the oil from the first chamber to the second chamber through the drain hole. On the other hand, when the drain hole is widened and oil is easily outpoured from the first chamber to the second chamber in removing the oil, low temperature oil in a lower part of the second chamber is sucked into the strainer through the drain hole in warming up (particularly in cold starting) and the proper function for reducing warming-up time of the double-tank type oil pan is diminished.

The present invention is made to address the problem which the above-mentioned conventional type double-tank type oil pan has and the object is to provide a double-tank type oil pan where an oil change can be more promptly made and a preferable lubricating device to which the double-tank type oil pan is applied.

To achieve such an object, the oil pan according to an aspect of the present invention is provided with a first chamber which is open to an object lubricated by oil and in which an oil suction opening connected to an oil pump for delivering oil to the lubricated object is arranged, a second chamber adjacent to the first chamber, a partition provided between the first chamber and the second chamber, a communicating opening provided to the partition so that the bottom part of the first chamber and the second chamber communicate and a shielding member provided to the bottom part of the first chamber and provided between the communicating opening and the oil suction opening.

A lubricating device according to an aspect of the present invention is provided with the oil pan including the first chamber open to the object lubricated by oil, the second chamber adjacent to the first chamber, the partition provided between the first chamber and the second chamber, the communicating opening provided to the partition so that the first chamber and the second chamber communicate at the bottom part of the first chamber and the shielding member provided to the bottom part of the first chamber and provided between the communicating opening and the oil suction opening, the oil pump for delivering oil to the lubricated object and a strainer having the oil suction opening open in the first chamber of the oil pan and connected to the oil pump via the oil channel.

According to the above-mentioned configuration, the communication of oil between the first chamber and the second chamber via the communicating opening provided to the partition so that the first chamber and the second chamber communicate at the bottom part of the first chamber is enabled when oil is removed. Accordingly, for example, where a drain plug hole is provided in the second chamber, in removing oil, oil in the second chamber flows outside the oil pan through the drain plug hole in removing oil, and oil in the first chamber flows into the second chamber through the communicating opening and then flows outside the oil pan through the drain plug hole. Further, as the communicating opening is provided at the bottom of the first chamber, the quantity of oil left in the first chamber when oil is removed can be possibly reduced.

At the same time, as the shielding member is provided between the communicating opening and the oil suction opening when oil in the first chamber is sucked through the oil suction opening by the oil pump while the lubricated object is operated, the shielding member may function as large resistance to a flow of oil generated from the communicating opening toward the oil suction opening. In other words, the communicating opening can be substantially shielded from negative pressure caused at the oil suction opening for sucking oil by the operation of the oil pump owing to an enclosure of the shielding member. Accordingly, even if the cross section of the communicating opening is sufficiently enlarged so that oil can promptly communicate between the first chamber and the second chamber when oil is removed and channel resistance at the communicating opening is decreased enough, oil in the second chamber hardly flows into the first chamber through the communicating opening when oil in the first chamber is sucked from the oil suction opening by the oil pump while the lubricated object is operated.

Therefore, when oil is removed, oil stored in either (the chamber where the drain plug hole for discharging oil outside the oil pan is not formed) of the first chamber or the second chamber can promptly flow out into the other (the chamber having the drain plug hole) through the communicating opening, while in the warming up (particularly in cold starting) of the lubricated object, an inflow of low temperature oil from the second chamber into the first chamber through the communicating opening can be restrained by the shielding member. Hereby, the promptness of an oil change which is the problem of the double-tank type oil pan can be achieved without attenuating a function for the reduction of warming-up time of the double-tank type oil pan.

From such a viewpoint, it is desirable that the shielding member is provided to the vicinity of the communicating opening at the bottom part of the first chamber between the communicating opening and the oil suction opening in a top view so as to interrupt a flow (at least a part) of oil connecting the communicating opening and the oil suction opening.

Besides, it is desirable that the communicating opening and the shielding member are both formed at the bottom panel of the first chamber.

In addition, it is desirable that the communicating opening is arranged in a lowest position in a direction in which gravity acts at the bottom panel of the first chamber and a face formed from an outer edge of the bottom panel of the first chamber to the communicating opening is flat or a downward slope. In the meantime, the above-mentioned direction in which gravity acts means a direction in which gravity acts when predetermined devices including this oil pan and the lubricated object are held in an operable condition on the level ground (the same applies hereinafter). Further, it is desirable that the bottom face of the first chamber is lower toward the communicating opening. That is, when a flow of oil from the outer edge of the bottom panel of the first chamber toward the communicating opening is supposed, it is desirable that the bottom face of the first chamber is formed so that oil does not flow in a direction reverse to the direction in which gravity acts (that is, in a direction in which oil rises).

It is desirable that this type of double-tank type oil pan is provided with an oil communicating channel that connects the first chamber and the second chamber so that the passability of oil changes according to an operational condition of the lubricated object such as proceedings of warming up (detailedly, so that the passage of oil is limited when the temperature of oil is low in warming up). Therefore, when the present invention is applied to the oil pan provided with the above-mentioned oil communicating channel, the oil pan is provided with the communicating opening provided to the partition so that the first chamber and the second chamber ordinarily communicate satisfactorily independent of the temperature of oil at the bottom part of the first chamber separately from the above-mentioned oil communicating channel in which the passage of oil is limited when the temperature of oil is low. Therefore, when oil is removed at extremely low temperature, oil can also be removed promptly using the communicating opening.

Besides, in the present invention, it is preferable that the communicating opening is formed at the end part in the top view of the first chamber. More preferably, the bottom of the first chamber is formed in a rectangle for example in the top view and the communicating opening is formed around one corner in the rectangle. Even more preferably, a central position in the top view of the oil suction opening is located between another corner diagonally opposite to the one corner in the rectangle and the center of the rectangle. Hereby, it is facilitated that the communicating opening is formed in as a distant position as possible from the oil suction opening and an effect of negative pressure caused in the oil suction opening upon the communicating opening (action that generates a flow of oil from the second chamber into the first chamber at the communicating opening) can be possibly reduced. Accordingly, a flow of oil through the communicating opening from the second chamber into the first chamber in the warming up of the lubricated object (particularly in cold starting) can be possibly restrained, maintaining the promptness of removing oil.

In addition, in the present invention, it is desirable that the shielding member is formed by a shielding plate planted at the bottom panel of the first chamber. Particularly, it is more preferable that the shielding plate is planted substantially perpendicularly from the bottom panel. Hereby, as an opening open to an intermediate part to an upper part of the first chamber can be formed at not less than an upper end of the shielding plate, an oil channel from the first chamber to the second chamber through the communicating opening is securely formed when oil is removed, and oil can be promptly removed. Besides, when the shielding plate and the partition are integrated, a mold having simple vertical type structure can be used and the partition can be formed at a low price in a simple process.

Further, in the present invention, it is desirable that the partition has a concave part forming the first chamber, the communicating opening is formed around the bottom of the concave part and the shielding plate is planted at the bottom panel of the partition.

It is preferable that the concave part contains an area surrounded by the bottom panel and the side panels surrounding the bottom panel of the partition. The inside of the oil pan is vertically divided into the first chamber formed by the area surrounded by the concave part (or the area on the upside of the partition and inside the concave part) and the second chamber formed by an area outside the first chamber by the partition (or an area on the downside of the partition). In addition, the communicating opening is formed by a through hole provided in a lowest position of the bottom of the concave part of the partition. In other words, this oil pan is configured so that oil can be discharged downward from the first chamber into the second chamber through the communicating opening formed in the lowest position at the bottom of the first chamber.

Hereby, when oil is removed, the quantity of residual oil in the first chamber located on the upside of the second chamber can be possibly reduced.

Besides, it is preferable that the shielding plate is provided opposite to a range equivalent to at least ¼ of the circumferential length of the communicating opening. More preferably, the shielding plate is provided opposite to a range equivalent to at least ½ of the circumferential length. Hereby, a flow of oil from the second chamber into the first chamber in the warming up of the lubricated object can be more effectively restrained by the shielding plate.

In addition, in the present invention, it is preferable that an oil passage which oil can pass is provided to the shielding plate. That is, for example, the oil passage in the shape of a slit or a through hole is formed in the shielding plate itself. (More preferably, the oil passage is provided to an end in the top view of the shielding plate.) Alternatively, in the present invention, it is preferable that the oil passage is provided between the shielding plate and the partition. That is, for example, clearance is made between one end or both ends in the top view of the shielding plate and the side of the partition and the clearance functions as the oil passage.

Hereby, as the communicating opening is shielded from an effect of negative pressure caused at the oil suction opening by the shielding plate when the lubricated object is operated, a flow of oil from the second chamber into the first chamber in warming up can be possibly restrained. At the same time, as a flow to the communicating opening of oil in the first chamber is secured by the oil passage when oil is removed, oil can be promptly removed through the oil passage.

It is preferable that the oil passage is formed so that a lower end of the oil passage reaches the bottom face of the first chamber. Hereby, as no obstacle to a flow of oil passing the oil passage exists at the lower end of the oil passage, the flow of oil is smooth. Accordingly, the quantity of oil left inside either where the drain plug hole is not formed of the first chamber or the second chamber when oil is removed (hereinafter merely called the quantity of residual oil) is possibly reduced, and the oil can be more securely removed.

Besides, it is preferable that the oil passage is provided outside an area connecting the communicating opening and the oil suction opening in the top view. That is, the whole or some of the area connecting the communicating opening and the oil suction opening (the area surrounded by common tangents drawn between a visible outline of the communicating opening and a visible outline of the oil suction opening and each visible outline of the communicating opening and the oil suction opening) in the top view is shielded by the shielding plate. Hereby, the communicating opening can be possibly shielded from an effect of negative pressure caused in the vicinity of the oil suction opening and an inflow of oil from the second chamber into the first chamber in warming up can be restrained with simple configuration.

In addition, in the present invention, it is preferable that the shielding member is formed by a tubular member provided along the bottom of the first chamber and from the communicating opening toward the inside of the first chamber. According to such configuration, as the communicating opening is covered with an external wall opposite to the oil suction opening of the tubular member, the communicating opening is shielded from negative pressure at the oil suction opening by the external wall of the tubular member in the warming up of the lubricated object. Accordingly, an inflow of oil from the second chamber into the first chamber by the negative pressure in warming up can be possibly restrained. When oil is removed, the prompt communication of oil can be made between the bottom part of the first chamber and the second chamber through the tubular member provided along the bottom part of the first chamber.

It is preferable that the tubular member is arranged so that the almost whole length of the tubular member is in contact with the bottom face of the first chamber. That is, it is preferable that the tubular member has an almost flat bottom panel in accordance with the bottom face of the first chamber.

Concretely, when the bottom face of the first chamber is flat for example, the bottom panel of the tubular member is also formed to be flat. More preferably, the cross section perpendicular to the central axis of the tubular member is semicircular or rectangular. Hereby, the quantity of residual oil when oil is removed is possibly reduced and the oil can be more promptly and more securely removed.

Besides, it is preferable that the tubular member has a first opening open to the first chamber and the first opening is arranged so that the first opening does not cross a line segment connecting the center of the communicating opening with the center of the oil suction opening in the top view. Or it is preferable that the tubular member is arranged so that an angle between an oriented line segment from the center of the communicating opening to the center of the oil suction opening and an oriented line segment from the first opening toward the outside of the tubular member along the central axis of the tubular member is in the range from 20 to 340 degrees (including 20 degrees and 340 degrees) in the top view.

That is, it is preferable that the tubular member is arranged so that it is not directed to the oil suction opening, and more preferably, so that it is directed to the reverse side to the oil suction opening. Hereby, as the external wall of the tubular member is opposite to the oil suction opening, the communicating opening can be more securely shielded from negative pressure at the oil suction opening by the external wall.

It is preferable that the above-mentioned angle is in the range from 45 to 315 degrees (including 45 degrees and 315 degrees). More preferably, the angle is in the range from 90 to 270 degrees (including 90 degrees and 270 degrees). Even more preferably, the angle is set to approximately 180 degrees. When the angle is in the range from 90 degrees to 270 degrees (including 90 degrees and 270 degrees), the first opening is not located between the communicating opening and the oil suction opening.

Besides, the oil pan according to the other aspect of the present invention is provided with the similar first chamber and the similar second chamber to those described above, a partition provided between the first chamber and the second chamber and having a concave part forming the first chamber, a communicating opening which is a through hole provided to the bottom of the concave part of the partition and a lid member arranged so that the lid member can close the communicating opening from the outside of the concave part, and the lid member is made of material having smaller specific gravity than oil.

That is, the inside of the oil pan is vertically divided by the partition into the first chamber formed by the area surrounded by the concave part (the area on the upside of the partition and inside the concave part) and the second chamber formed by the area outside the first chamber (the area on the downside of the partition). The communicating opening is formed as a through hole provided to the bottom of the concave part of the partition so that the bottom part of the first chamber and the second chamber communicate. In other words, the oil pan is configured so that oil can be discharged downward from the first chamber into the second chamber through the communicating opening formed at the bottom of the first chamber. The lid member is arranged immediately under the communicating opening in (the bottom part of) the second chamber and on the downside of the bottom of the concave part of the partition forming the first chamber. Also the lid member is configured so that the lid member can close the communicating opening by touching it to the communicating opening from the downside of the first chamber.

According to such configuration, as oil is stored in the first chamber and the second chamber when a lubricated object is operated (including warming up), buoyancy acts on the lid member in the oil. Accordingly, the lid member is lifted to a position in which the lid member is touched to the communicating opening by the buoyancy and the communicating opening is closed by the lid member. Therefore, it can be restrained that oil at the bottom part of the second chamber flows into the first chamber through the communicating opening by negative pressure caused at the oil suction opening. On the other hand, in the removal of oil, when oil in the second chamber is discharged and an oil level in the second chamber lowers to predetermined height, force that presses down the lid member by the pressure of oil left in the first chamber becomes larger than buoyancy that acts on the lid member, the lid member is displaced downward, the communicating opening is released, residual oil in the first chamber flows downward through the communicating opening by gravity, and flows into the second chamber.

In addition, the oil pan according to the other aspect of the present invention is provided with the similar first chamber and the similar second chamber to those described above, a partition provided between the first chamber and the second chamber and having a concave part forming the first chamber, a communicating opening which is a through hole provided at the bottom of the concave part of the partition so that the bottom part of the first chamber and the second chamber communicate, a lid member arranged so that the communicating opening can be closed from the outside (the downside) of the concave part, a float member made of material having smaller specific gravity than oil and arranged inside (on the upside of) the concave part so that the float member is opposite to the lid member across the communicating opening between the float member and the lid member and a coupling member that pierces the communicating opening and couples the lid member and the float member. That is, this oil pan is provided with a float valve including the lid member, the float member and the coupling member.

According to such configuration, the inside of the oil pan has configuration that oil can be discharged downward from the first chamber into the second chamber through the communicating opening formed at the bottom part of the first chamber. The float member is arranged inside the first chamber over the communicating opening and the lid member coupled to the float member via the coupling member is arranged under the communicating opening and the float member (that is, under the bottom of the concave part forming the first chamber). When the float member is lifted, the lid member is pulled up by the float member via the coupling member and also rises, and when the float member is lifted up to a predetermined position, a top face of the lid member is touched to the partition and closes the communicating opening. Conversely, when the float member lowers under the predetermined position, the top face of the lid member separates from the partition, and the communicating opening is released.

Accordingly, when oil that is equal to or exceeds predetermined quantity is stored in the first chamber and an oil level in the first chamber is equal to or exceeds the predetermined height, the float member is lifted up to the predetermined position by the buoyancy of the float member, the lid member is hereby pulled up via the coupling member and is touched to the partition, and as a result, the communicating opening is closed. That is, when a lubricated object is operable, the communication of oil between the first chamber and the second chamber through the communicating opening is limited (substantially cut off). On the other hand, as the float member is displaced on the downside of the predetermined position when an oil level in the first chamber is equal to or is lower than the predetermined height while oil is removed, the lid member is separated from the partition, the communicating opening is released, and oil in the first chamber can flow out into the second chamber through the released communicating opening. Therefore, oil is promptly discharged and residual oil in the first chamber located on the upside of the second chamber can be possibly reduced.

In this case, the lid member may also be formed so that a surface opposite to the communicating opening of the lid member has a spherical part. Particularly, it is preferable that the surface touched to an open end of the communicating opening when the lid member is located in an upper position and closes the communicating opening has a spherical part.

According to such configuration, even if the float valve located in the upper position is inclined because oil is moved in the oil pan in starting, stopping, turning and ascending and descending a slope when a vehicle is operated, the spherical part of the surface of the lid member is satisfactorily touched to the communicating opening. Accordingly, the ill-planned communication of oil between the first chamber and the second chamber through the communicating opening in operation (particularly in warming up) can be restrained.

In addition, a guide member opposite to the coupling member may also be further provided.

For example, the guide member is formed so that the guide member surrounds the coupling member. The guide member is formed so that it can guide vertical motions of the lid member and the float member.

According to such configuration, the inclination of the float valve located in the upper position in operation can be restrained.

Further, the oil pan according to the other aspect of the present invention is provided with the first chamber and the second chamber similar to those described above, a partition provided between the first chamber and the second chamber and having a concave part forming the first chamber, a communicating opening which is a through hole provided at the bottom of the concave part of the partition and a characteristic float valve inside which an oil channel in the float valve is formed. The float valve is configured by a lid member, a float member, a stem member, a rise regulating member and the oil channel in the float valve.

The lid member is arranged so that it can close the communicating opening from the outside of the concave part.

The float member is made of material having smaller specific gravity than oil and is arranged inside the concave part opposite to the lid member across the communicating opening.

The stem member is integrated with the lid member so that the stem member is upwardly extended toward the inside of the concave part from the lid member and is formed so that vertical motion of the float member according to an oil level in the first chamber can be guided.

The rise regulating member is integrated with an upper end of the stem member and is formed so that the rise of the float member can be regulated by touching the rise regulating member to an upper surface of the float member.

The oil channel in the float valve pierces the lid member, the stem member and the rise regulating member so that a second chamber-side opening formed on a surface on the side of the second chamber of the lid member and a first chamber-side opening formed on a lower surface of the rise regulating member for being touched to the upper surface of the float member communicate.

In such configuration, when an oil level in the first chamber is sufficiently high, the float member is lifted up to an upper position in which the float member is touched to the rise regulating member. The upper surface of the float member lifted up to the upper position is touched to the lower surface on which the first chamber-side opening is formed of the rise regulating member. Hereby, the first chamber-side opening is closed by the upper surface of the float member. That is, the first chamber-side opening which is an opening on the side of the first chamber of the oil channel in the float valve formed in the float valve is closed by the upper surface of the float member. Hereby, the communication of oil between the first chamber and the second chamber via the oil channel in the float valve is restrained (cut off).

On the other hand, when an oil level in the first chamber lowers, the float member lowers from the upper position. At this time, the bottom of the lid member is upward pressed by oil pressure in the second chamber so that the lid member closes the communicating opening. Accordingly, only the float member lowers in a state in which the lid member closes the communicating opening (the lid member, the stem member and the rise regulating member are located in the upper position).

At this time, the first chamber-side opening having been closed by the upper surface of the float member is released. Then, the oil channel in the float valve between the second chamber-side opening formed at the bottom of the lid member (on the surface on the second chamber side) and the first chamber-side opening is opened up. Oil in the second chamber flows into the oil channel in the float valve from the second chamber-side opening formed at the bottom of the lid member by oil pressure acting on the bottom of the lid member and flows into the first chamber from the first chamber-side opening at an end of the oil channel in the float valve.

According to such configuration, when an oil level in the first chamber is extremely low in warming up (when for example, only a little oil is stored immediately before starting at low temperature), oil can be supplied from the second chamber into the first chamber via the oil channel in the float valve.

In this case, the lid member may also be formed so that the surface opposite to the communicating opening of the lid member has a spherical part. Particularly, it is preferable that the surface to be touched to the open end of the communicating opening when the float valve is located in the upper position and the communicating opening is closed by the lid member has the spherical part.

According to such configuration, even if the float valve located in the upper position is inclined in operation, the spherical part of the surface of the lid member is in satisfactory contact with the communicating opening. Accordingly, the ill-planned communication of oil between the first chamber and the second chamber via the communicating opening in operation (particularly in warming up) can be restrained.

Besides, a guide member may also be further provided opposite to the stem member.

For example, the guide member surrounds the stem member. The guide member is formed so that it can guide vertical motion of the lid member, the stem member and the rise regulating member.

According to such configuration, the inclination of the float valve located in the upper position in operation can be restrained.

Furthermore, the oil pan according to the other aspect of the present invention is provided with a first chamber open to an object lubricated by oil, a second chamber adjacent to the first chamber and communicating with the first chamber via an oil communicating channel, a partition provided between the first chamber and the second chamber and a communicating opening provided to the partition so that the first chamber and the second chamber communicate at the bottom part of the first chamber, and the communicating opening is formed at an end part in a top view of the first chamber. It is preferable that when an oil suction opening connected to an oil pump for delivering oil to the lubricated object is arranged in the first chamber, distance between the centers of the oil suction opening and the communicating opening in the top view is a half of the length of a diagonal line of a rectangle or longer for example. Or the bottom of the first chamber is formed in the rectangle in the top view and the communicating opening is formed around one corner of the rectangle. In addition, it is more preferable that a central position in the top view of the oil suction opening is located between another corner diagonally opposite to one corner described above of the rectangle and the center of the rectangle. Hereby, the communicating opening can be kept as distant as possible from the oil suction opening and as a result, the action of negative pressure at the oil suction opening on the communicating opening can be possibly reduced.

As described above, according to the present invention, in the double-tank type oil pan and the lubricating device to which the double-tank type oil pan is applied, configuration in which oil can be changed more promptly can be realized by the simple configuration.

BRIEF DESCRIPTION OF THE DRAWINGS

FIG. 9 show one example of the concrete configuration of the circumference of a float valve shown in FIG. 8.

FIG. 11 show a modification of the configuration of the circumference of the float valve shown in FIG. 9.

FIG. 13 show still another transformed example of the configuration of the circumference of the float valve shown in FIG. 9.

BEST MODE FOR CARRYING OUT THE INVENTION

Figure 1:
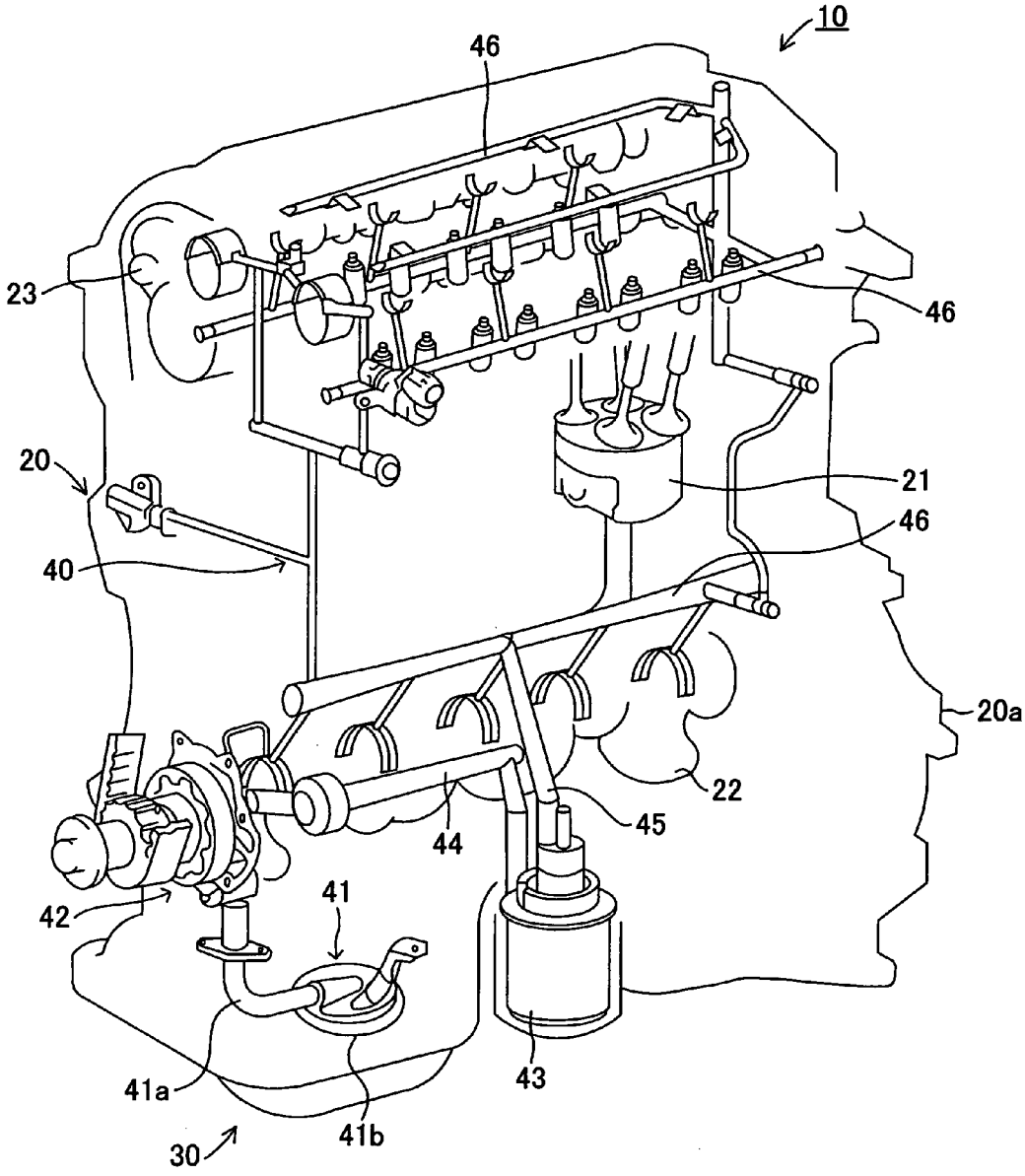
FIG. 1 is a schematic diagram showing an engine to which a lubricating device provided with an oil pan as an embodiment of the present invention is applied.

Referring to the drawings, embodiments (embodiments thought best by the applicant when this specification is applied) of the present invention will be described below.

Schematic Configuration of Embodiments

FIG. 1 shows the schematic configuration of an engine to which a lubricating device provided with an oil pan in this embodiment is applied. The engine 10 is provided with a cylinder block part 20, an oil pan 30 and a lubricating system 40. The lubricating device in this embodiment is configured by the oil pan 30 and the lubricating system 40.

The cylinder block part 20 is provided with a cylinder block 20*a* and plural moving parts arranged in the cylinder block 20*a*, including a piston 21, a crankshaft 22 and a camshaft 23.

The oil pan 30 is fixed at a lower end of the cylinder block 20*a* by bolts and is a member for storing oil to be supplied to moving parts such as the piston 21 to be lubricated.

The lubricating system 40 is provided with a strainer 41 arranged in the oil pan 30, an oil pump 42 provided to the cylinder block 20*a*, an oil filter 43 provided outside the cylinder block 20*a* so that the oil filter is adjacent to the cylinder block 20*a*, an oil transport pipe 44 provided as an oil channel connecting an oil inlet of the oil filter 43 and the oil pump 42, an oil supply pipe 45 connected to an oil outlet of the oil filter 43 and an oil delivery pipe 46 provided as an oil channel from the oil supply pipe 45 to each moving part.

The strainer 41 is provided with a strainer channel 41*a* which is an oil channel for supplying oil to the oil pump 42 and a suction opening 41*b* for sucking oil stored in the oil pan 30.

The oil delivery pipe 46 is piping for distributing filtered oil supplied from the oil supply pipe 45 to each oil discharge port provided to the cylinder block 20*a* to supply oil to each moving part.

Configuration of Main Part in First Embodiment

Figure 2A:
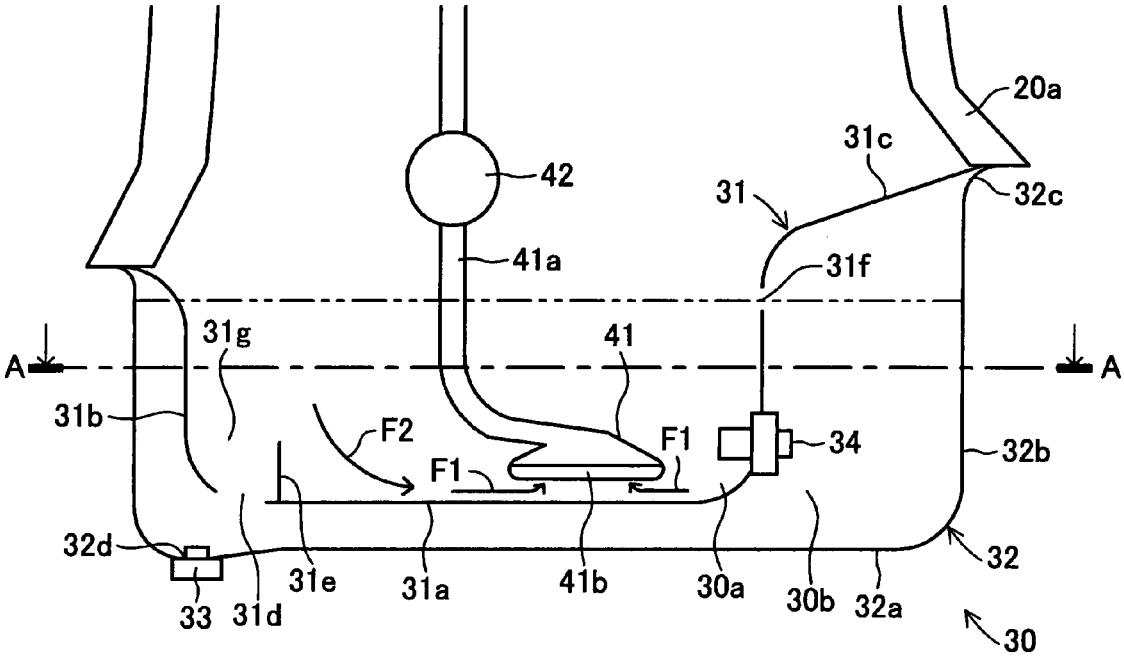
FIG. 2 are schematic diagrams for explaining the configuration of a main part in a first embodiment.
Figure 2B:
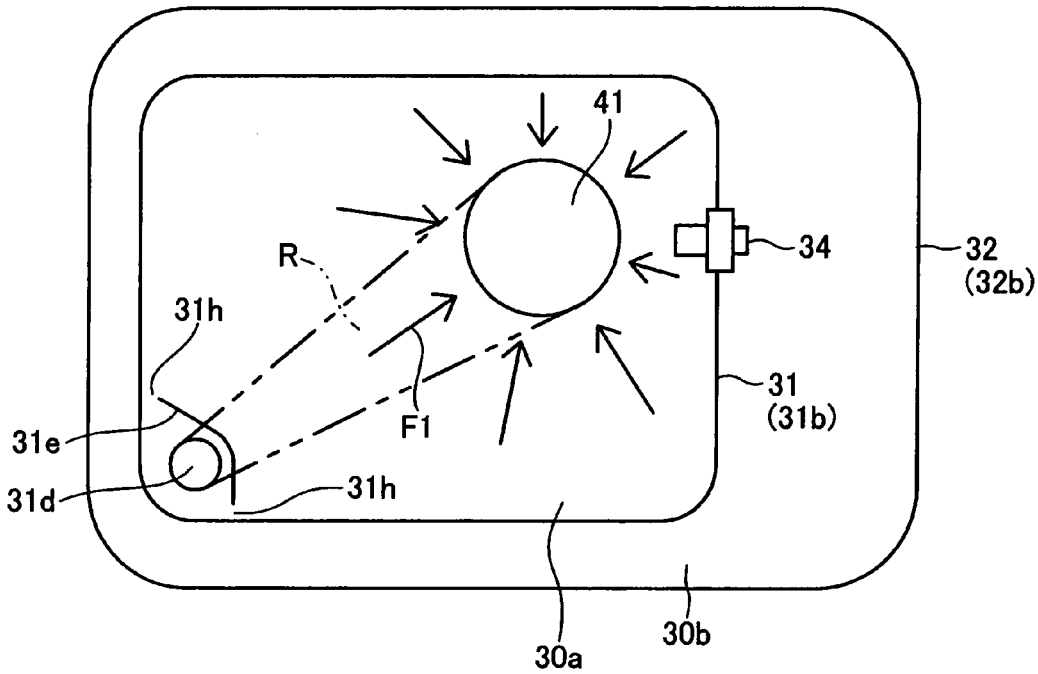

FIG. 2 are schematic diagrams for explaining the configuration of a main part in a first embodiment of the present invention (FIG. 2A is a side sectional view and FIG. 2B is a sectional view viewed along a line A-A in FIG. 2A. However, for the sake of understanding of the contents of the present invention, a part of a visible outline to be expressed rightfully in FIG. 2 is omitted. It is also similar in FIGS. 3 to 6 which are explanatory drawings for explaining second to sixth embodiments).

The oil pan 30 is provided with an oil pan separator 31 that partitions a first chamber 30*a* communicating with the moving part inside the cylinder block 20*a* and a second chamber 30*b* which is outside of the first chamber 30*a*, an oil pan cover 32 which is arranged outside the oil pan separator 31 and which forms an outside cover of the oil pan 30, a drain plug 33 that can be detached from the oil pan cover 32 and a thermo valve apparatus 34 installed on the oil pan separator 31.

The oil pan separator 31 is a bathtub type member configured by a bottom panel 31*a*, a side panel 31*b* provided so as to encircle the bottom panel 31*a* and a flange 31*c* provided to a circumference on the upside of the side panel 31*b* and is formed by injection-molding synthetic resin. The first chamber 30*a* is formed by a concave part configured by the bottom panel 31*a* and the side panel 31*b*. The first chamber 30*a* is formed substantially rectangularly at the bottom in a top view as shown in FIG. 2B.

The strainer 41 is arranged with predetermined small clearance between the suction opening 41*b* and the bottom panel 31*a* inside the first chamber 30*a*. That is, the suction opening 41*b* of the strainer 41 is arranged at the bottom part of the first chamber 30*a* so that the suction opening is opposite to the bottom panel 31*a* of the first chamber 30*a* across the predetermined small clearance. A flow of oil along the bottom panel 31*a* (hereinafter called main flow) F1 is radially formed as shown in FIG. 2B by such arrangement when oil stored in the first chamber 30*a* is sucked via the suction opening 41*b* of the strainer 41. As shown in FIG. 2B, the strainer 41 is arranged close to one corner (a right upper corner of the first chamber 30*a* in FIG. 2B) of the almost rectangular bottom of the first chamber 30*a* in the top view.

In a lowest part (a lowest part in a direction in which gravity acts when predetermined devices including the engine 10 are held in an operable condition on the level ground) of the bottom panel 31*a* of the first chamber 30*a*, a communicating hole for drain 31*d* is formed. The communicating hole for drain 31*d* is an almost circular through hole in the top view provided as a communicating opening via which the first chamber 30*a* and the second chamber 30*b* ordinarily communicate in the lowest part of the first chamber 30*a* and is formed in a large diameter (concretely approximately 20 mm in diameter) enough to pass oil even if the viscosity of the oil is high in cold climate. Further, the bottom panel 31*a* is formed so that a face from an outer edge of the bottom panel 31*a* to the communicating hole for drain 31*d* formed in the lowest part is flat or a downward slope (that is, there is no upward slope). In other words, the bottom panel 31*a* is formed so that no oil flows in a direction (that is, a direction in which oil rises) reverse to the direction in which gravity acts when the flow of oil from the outer edge of the bottom panel 31*a* of the first chamber 30*a* toward the communicating hole for drain 31*d* is supposed.

Besides, as clear from FIG. 2B, the communicating hole for drain 31*d* is formed around a corner (a left lower corner of the first chamber 30*a* in FIG. 2B) diagonally opposite to one corner where the strainer 41 is arranged at the bottom part of the almost rectangular first chamber 30*a* in the top view. That is, the communicating hole for drain 31*d* is formed in a diagonally opposite position to the strainer 41 so that the communicating hole for drain is located in as distant a position from the strainer 41 (and the suction opening 41*b*) as possible. The center distance in the top view between the strainer 41 and the communicating hole for drain 31*d* is set so that the center distance is equal to or longer than a half of a diagonal line in the rectangle.

A shielding plate 31*e* is planted in the lowest part of the bottom panel 31*a* of the first chamber 30*a* so that the shielding plate surrounds the communicating hole for drain 31*d*. That is, as clear from FIG. 2B, the shielding plate 31*e* is planted around the one corner described above where the communicating hole for drain 31*d* is formed at the bottom of the almost rectangular first chamber 30*a* in the top view substantially perpendicularly from the bottom panel 31*a* so that the shielding plate is located between the communicating hole for drain 31*d* and the strainer 41 (the suction opening 41*b*) in the top view. The shielding plate 31*e* is made of the same material as that of the bottom panel 31*a* of the oil pan separator 31 and is integrated with the bottom panel 31*a*. That is, the bottom panel 31*a*, the side panel 31*b*, the flange 31*c* and the shielding plate 31*e* of the oil pan separator 31 are integrated.

The height of the shielding plate 31*e* is set so that the shielding plate is located in a higher position than at least the suction opening 41*b* of the strainer 41 when the predetermined devices including the engine 10 are held in the operable condition on the level ground. Concretely, the shielding plate 31*e* is planted so that in the operable condition on the level ground, an upper end of the shielding plate 31*e* is located at the almost same height as the height of an oil level (the height of an oil level when an oil level gauge on a display panel not shown for monitoring an operational status of the engine 10 displays "EMPTY") when oil of quantity equivalent to 1/10 of the maximum oil storage of the oil pan 30 is stored. An upper opening 31*g* surrounded by the shielding plate 31*e* and the side panel 31*b* of the oil pan separator 31 is formed at the upper end of the shielding plate 31*e*. That is, even if the viscosity of oil is high in cold climate, oil in an upper part of the first chamber 30*a* can flow toward the communicating hole for drain 31*d* through the upper opening 31*g*.

The shielding plate 31*e* is formed in an almost circular arc having enough length to cross an area R connecting the communicating hole for drain 31*d* with the strainer 41 (the suction opening 41*b*) in the top view as shown in FIG. 2B. The above-mentioned area R means an area encircled by common tangents drawn between a visible outline of the communicating hole for drain 31*d* and a visible outline of the strainer 41 (the suction opening 41*b*), the visible outline of the communicating hole for drain 31*d* and the visible outline of the strainer 41 (the suction opening 41*b*) in the top view. A slit 31*h* which is clearance between the following end of the shielding plate 31*e* and the side panel 31*b* of the oil pan separator 31 is formed at both ends in the top view of the shielding plate 31*e*. In other words, the slit 31*h* is provided outside the area R. The width of the slit 31*h* is set to enough width to pass oil even if the viscosity of the oil is high in cold climate, concretely to approximately 10 mm. A lower end of the slit 31*h* reaches the bottom panel 31*a* of the oil pan separator 31 and oil can pass on the bottom panel 31*a* when the oil pass the slit 31*h*.

Further, upper communicating holes 31*f* are provided to an upper part of the side panel 31*b* of the oil pan separator 31. The upper communicating hole 31*f* is a through hole, and plural upper communicating holes are provided in a range between the height of an oil level (the height of an oil level shown by a chain double-dashed line in FIGS. 2A, 3A, 4A, 5A, and 6A when the oil level gauge displays "FULL" in the operable condition on the level ground) when oil of the maximum oil storage is stored and the height of an oil level (the height of an oil level when the oil level gauge displays an intermediate point of FULL and EMPTY) when oil equivalent to a half of the maximum oil storage is stored. The upper communicating hole 31*f* has enough size to hold oil levels of the first chamber 30*a* and the second chamber 30*b* equal because oil in the second chamber 30*b* flows into the first chamber 30*a* when an oil amount in the first chamber 30*a* decreases in the range of oil levels between FULL and HALF. The upper communicating hole is formed in a circle having a diameter of approximately 10 mm, in an ellipse or a polygon having area equivalent to the circle.

The oil pan cover 32 is a bathtub type member configured by a bottom panel 32*a*, a side panel 32*b* encircling the bottom panel 32*a* and a flange 32*c* provided to a circumference on the upside of the side panel 32*b*, and is formed by stamping a steel sheet. The oil pan separator 31 and the oil pan cover 32 are fixed to the cylinder block 20*a* by jointly fastening the flange 31*c* of the oil pan separator 31 and the flange 32*c* of the oil pan cover 32 to the lower end of the cylinder block 20*a* by a bolt.

A drain plug hole 32*d* is formed in the lowest part of the bottom panel 32*a* of the oil pan cover 32. The drain plug hole 32*d* is a through hole having a diameter of approximately 20 mm and is provided to discharge oil in an oil change. The drain plug hole 32*d* is formed as a tapped hole at its inner edge of which a thread is formed.

The drain plug 33 is a bolt matched with the thread of the drain plug hole 32*d*. The drain plug 33 is formed so that the drain plug hole 32*d* is closed by screwing the drain plug on the tapped hole of the drain plug hole 32*d* and the drain plug can function as a plug for blocking the outflow of oil from the second chamber 30*b* outside the oil pan 30.

The thermo valve apparatus 34 is provided with a well-known wax type thermostatic valve used for a cooling water circulating system of an automobile inside the body and when temperature is equal to or exceeds predetermined valve opening temperature, alternate currents of oil are enabled between the first chamber 30*a* and the second chamber 30*b* through the inside of the body of the thermo valve apparatus 34 (hereinafter merely called the inside of the thermo valve apparatus 34). Besides, the thermo valve apparatus 34 is configured so that a valve opening rate (the ratio of current channel cross-sectional area to maximum channel cross-sectional area inside the thermo valve apparatus 34) is higher as temperature rises. That is, an oil communicating channel between the first chamber 30*a* and the second chamber 30*b* is formed inside the thermo valve apparatus 34 (in a condition in which the valve is opened at temperature equal to or exceeding the valve opening temperature). The thermo valve apparatus 34 is arranged on the side panel 31*b* of the oil pan separator 31 so that the thermo valve apparatus is located in a lower part of the concave part, that is, on the downside of positions of all the upper communicating holes 31*f* and on the slight upside of the bottom panel 31*a* of the oil pan separator 31 and the suction opening 41*b* of the strainer 41. Concretely, the oil level at the time of EMPTY and the center in a vertical direction of the thermo valve apparatus 34 are set so that they are as the almost same level.

Operation in First Embodiment

Next, the operation of the oil pan 30 and the lubricating system 40 in this embodiment provided with the above-mentioned configuration will be described.

When the operation of the engine 10 is started, vertical motion of the piston 21 based upon a cyclic motion of the internal combustion engine is converted to a rotational motion of the crankshaft 22, the oil pump 42 sucks oil stored in the first chamber 30*a* of the oil pan 30 from the suction opening 41*b* of the strainer 41 by the rotation of a rotor 42*a* of the oil pump 42 attached to the crankshaft 22, discharges and delivers the sucked oil to the oil transport pipe 44.

The oil pumped from the oil pump 42 into the oil transport pipe 44 is transported to the oil filter 43 through the oil transport pipe 44 and is filtered by the oil filter 43. The filtered oil is supplied to the oil delivery pipe 46 through the oil supply pipe 45 and is supplied to each moving part such as the piston 21, the crankshaft 22 and the camshaft 23 from the oil delivery pipe 46. Hereby, the oil supplied to each moving part functions as lubricating oil in each moving part and after the oil absorbs frictional heat caused when each moving part is operated, it is scavenged in the first chamber 30*a* because the oil drops because of gravity.

<During Warming Up>

When oil is sucked from the suction opening 41*b* of the strainer 41 as shown in FIG. 2 in warming up, a main flow F1 of oil to the suction opening 41*b* along the bottom panel 31*a* in the vicinity of the suction opening 41*b* is radially generated with the suction opening 41*b* in the center in the top view by negative pressure caused at the suction opening 41*b* by the operation of the oil pump 42.

However, as described above, the shielding plate 31*e* is planted between the communicating hole for drain 31*d* and the suction opening 41*b* in the vicinity of the suction opening 41*b* so that the shielding plate crosses the area R connecting the communicating hole for drain 31*d* and the strainer 41 (the suction opening 41*b*) in the top view. Therefore, the communicating hole for drain 31*d* is substantially shielded from an effect of the main flow F1 by the shielding plate 31*e* and an inflow of oil from the second chamber 30*b* into the first chamber 30*a* through the communicating hole for rain 31*d* is blocked. On the other hand, a flow F2 of oil from the upside of the inside (the center side in the top view of the first chamber 30*a*) of the shielding plate 31*e* to the suction opening 41*b* is generated.

As the thermo valve apparatus 34 is formed by the well-known wax type thermostatic valve as described above, the oil communicating channel passing inside the thermo valve apparatus 34 is closed at lower temperature than the predetermined valve opening temperature. In warming up, as the temperature of oil in the first chamber 30*a* (and in the second chamber 30*b*) is lower than the valve opening temperature, the thermo valve apparatus 34 is not opened. Accordingly, the oil communicating channel passing inside the thermo valve apparatus 34 is closed. Therefore, no inflow of oil through the oil communicating channel inside the thermo valve apparatus 34 from the second chamber 30*b* into the first chamber 30*a* by the effect of the main flow F1 is caused.

As described above, in warming up, an inflow of low temperature oil in a lower part of the second chamber 30*b* into the first chamber 30*a* through the oil communicating channel inside the thermo valve apparatus 34 and the communicating hole for drain 31*d* is effectively blocked. (That is, an inflow of oil from the second chamber 30*b* into the first chamber 30*a* is limited to an inflow of oil in an upper part (oil temperature is higher than the low temperature oil in the lower part of the second chamber 30*b*) of the second chamber 30*b* through the upper communicating hole 31*f* when an oil level of the first chamber 30*a* lowers.) Accordingly, oil supplied to each moving part to be lubricated is almost limited to oil in the first chamber 30*a*. In other words, heat capacity in the oil pan 30 is reduced. Therefore, the temperature of oil supplied to each moving part to be lubricated in warming up is effectively prevented from being excessively lowered by the inflow of low temperature oil from the bottom of the second chamber 30*b* and the proceedings of warming up can be accelerated.

<End of Warming Up>

Afterward, when warming up proceeds and the temperature of oil in the first chamber 30*a* rises, heat is gradually transmitted from the oil in the first chamber 30*a* to oil in the second chamber 30*b* via the oil pan separator 31 and the temperature of the oil in the second chamber 30*b* also gradually rises. When the temperature of oil in the first chamber 30*a* and the second chamber 30*b* around the thermo valve apparatus 34 rises up to the valve opening temperature of the thermo valve apparatus 34, the communication of the oil communicating channel inside the thermo valve apparatus 34 is started. Hereby, the effect (that is, the effect of the negative pressure caused at the suction opening 41*b*) of the main flow F1 of oil along the bottom panel 31*a* when oil is sucked at the suction opening 41*b* of the strainer 41 reaches the oil communicating channel, oil at the bottom of the second chamber 30*b* passes the oil communicating channel, and flows into the first chamber 30*a*. According to the inflow of oil from the second chamber 30*b* into the first chamber 30*a* through the oil communicating channel, oil in the upper part of the first chamber 30*a* flows from the upper communicating hole 31*f* into the second chamber 30*b*. As described above, as low temperature oil at the bottom of the second chamber 30*b* flows into the first chamber 30*a* through the oil communicating channel and simultaneously, high temperature oil in the upper part of the first chamber 30*a* flows into the second chamber 30*b* through the upper communicating hole 31*f*, oil in the oil pan 30 is circulated.

Particularly, as described above, the thermo valve apparatus 34 is provided with configuration that the valve opening rate gradually increases as temperature rises. Accordingly, immediately after the temperature of oil around the thermo valve apparatus 34 reaches the valve opening temperature immediately after warming up is finished, the valve opening rate of the thermo valve apparatus 34 is low and only a small quantity of low temperature oil at the bottom of the second chamber 30*b* flows into the first chamber. Accordingly, in this case, each moving part is prevented from being precipitously cooled when a large quantity of low temperature oil flows into the first chamber 30*a*, is sucked in the strainer 41 and is supplied to each moving part. On the other hand, when time sufficiently elapses after warming up is finished and the temperature of oil in the first chamber 30*a* rises considerably, the valve opening rate of the thermo valve apparatus 34 increases and the circulation of oil is activated. Therefore, in this case, as all the quantity of oil in the oil pan 30 is evenly supplied for lubrication, the durability of oil is enhanced, as heat capacity in the oil pan 30 increases, the excessive rise of the temperature of oil can be restrained, and the overheat of the engine 10 can be restrained.

<Oil Change>

An oil change is performed by pulling out the drain plug 33 from the drain plug hole 32*d* when the engine is stopped. That is, oil in the second chamber 30*b* is discharged from the drain plug hole 32*d* by pulling out the drain plug 33. As the first chamber 30*a* is located inside the second chamber 30*b* and the second chamber 30*b* is formed substantially throughout the lower part and the side of the first chamber 30*a*, oil in the first chamber 30*a* is required to be streamed outside the oil pan 30 from the drain plug hole 32*d* after the oil is once outpoured from the first chamber 30*a* into the second chamber 30*b* to remove the oil in the first chamber 30*a*.

The oil change is to be performed when the engine is stopped and preferably when the temperature of oil is low. In this condition, as the temperature of oil is lower than the valve opening temperature of the thermo valve apparatus 34, the oil communicating channel in the thermo valve apparatus 34 cannot be used for removing the oil in the first chamber 30*a*.

On the other hand, as described above, the communicating hole for drain 31*d* is formed as a through hole large enough for oil to pass even if the viscosity of oil is high in cold climate. Therefore, when oil is to be removed, oil in the first chamber 30*a* can promptly flow into the second chamber 30*b* through the communication hole for drain 31*d*. As the communicating hole for drain 31*d* is formed in the lowest part of the bottom panel 31*a* of the first chamber 30*a*, oil is hardly left in the first chamber 30*a* when the oil is removed from the first chamber 30*a*. Therefore, in the oil pan 30, oil in the first chamber 30*a* can be promptly and securely removed without being almost left in the first chamber 30*a* by only pulling out the drain plug 33.

As described above, according to the configuration of the oil pan 30 in this embodiment, control according to the proceedings of warming up over the alternate currents of oil between the first chamber 30*a* and the second chamber 30*b* is securely made by the thermo valve apparatus 34 with the simple configuration, and when oil is to be removed, oil can be promptly discharged from the first chamber 30*a* into the second chamber 30*b* through the communicating hole for drain 31*d* which is separately provided from the thermo valve apparatus 34 and which ordinarily connects the first chamber 30*a* and the second chamber 30*b*. The inflow of low temperature oil from the communicating hole for drain 31*d* into the first chamber 30*a* is possibly prevented by the shielding plate 31*e*. Therefore, according to this embodiment, the oil pan and the lubricating device that enable a prompt oil change can be realized, reducing warming up time in cold starting.

Second Embodiment

Figure 3A:
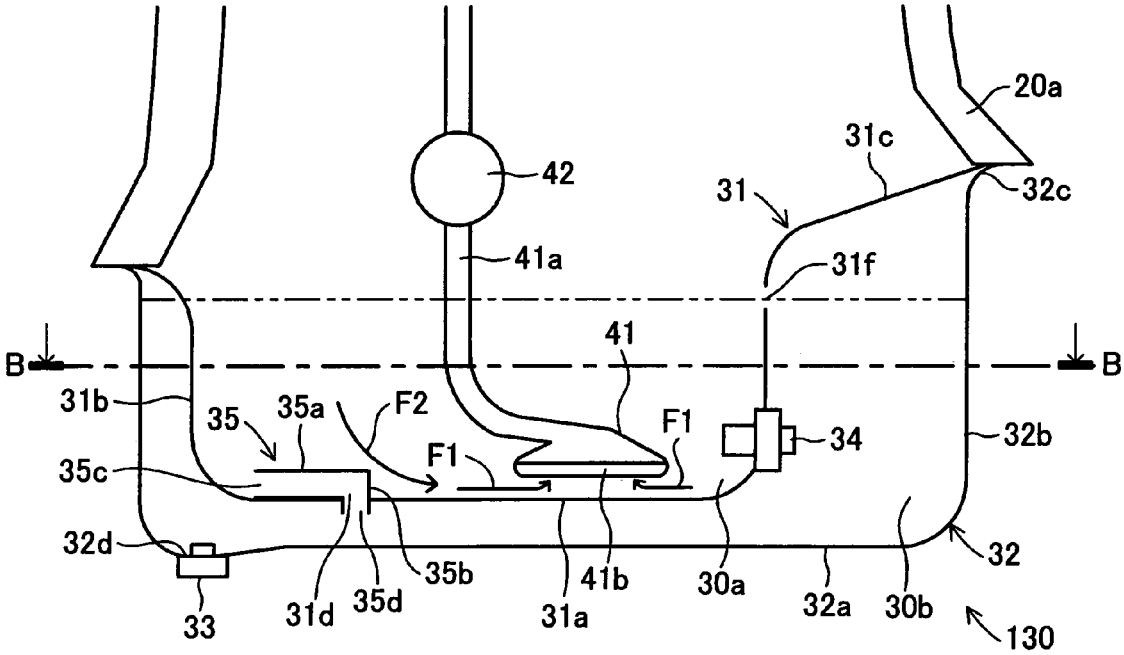
FIG. 3 are schematic diagrams for explaining the configuration of a main part in a second embodiment.
Figure 3B:
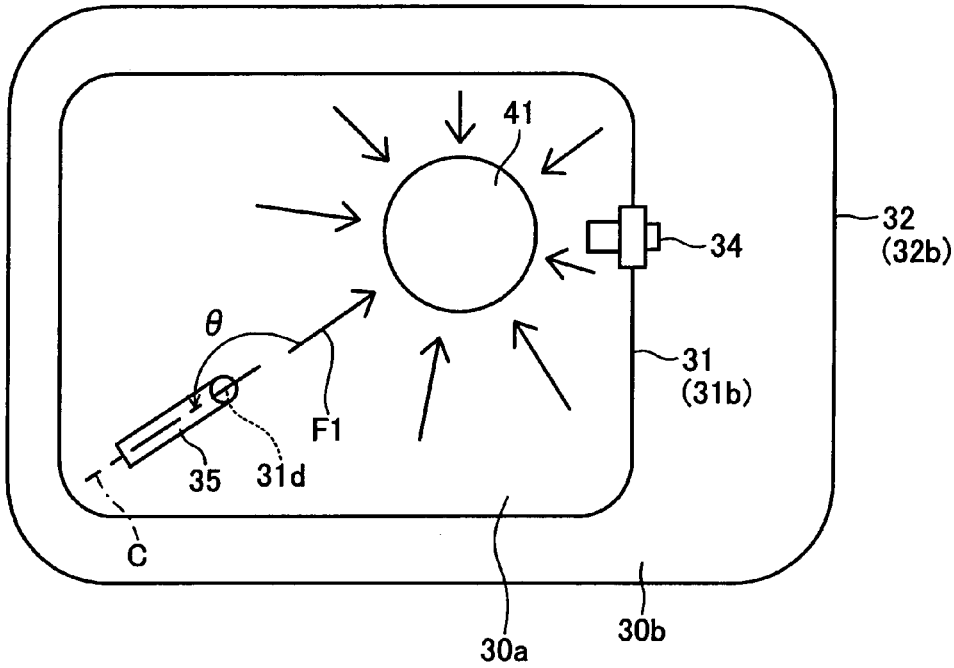

FIG. 3 are schematic diagrams for explaining the configuration of a main part of an oil pan 130 in a second embodiment of the present invention, FIG. 3A is a side sectional view, and FIG. 3B is a sectional view viewed along a line B-B in FIG. 3A. The same reference numeral is allocated to an element having the similar action and function to the first embodiment and the description is omitted (also similar in another embodiments described later).

A communicating pipe for drain 35 as a tubular member is arranged in a lowest part of a bottom panel 31*a* of an oil pan separator 31 inside a first chamber 30*a* in the oil pan 130 in this embodiment. The communicating pipe for drain 35 is provided with a pipe base 35*a* forming a main part of the communicating pipe for drain 35 and a connection part 35*b* connected to one end of the pipe base 35*a* and provided so that the connection part vertically pierces the bottom panel 31*a* of the oil pan separator 31, and the pipe base and the connection part are integrated. The connection part 35*b* is arranged so that the connection part pierces a communicating hole for drain 31*d*.

The pipe base 35*a* is a tubular member the shape of a section perpendicular to a central axis C of which is almost rectangular and is arranged on the bottom panel 31*a* so that the rectangular bottom is touched to the bottom panel 31*a* in the almost overall length of the pipe base 35*a*. An inlet port 35*c* as a first opening is formed to the other end (an end on the different side from the one end which is the side connected to the connection part 35*b*) of the pipe base 35*a*. The communicating pipe for drain 35 is configured so that oil stored in the first chamber 30*a* (particularly in the vicinity of the bottom panel 31*a* of the oil pan separator 31 which is the lowest part of the first chamber 30*a*) is smoothly taken from the inlet port 35*c* into the communicating pipe for drain 35 when oil is removed and can be promptly discharged from a discharge port 35*d* which is an opening at a lower end of the connection part 35*b* into a second chamber 30*b*.

As shown in FIG. 3B, the communicating pipe for drain 35 is arranged so that the inlet port 35*c* which is an opening at the end of the pipe base 35*a* is open in a reverse direction to the strainer 41. That is, the communicating pipe for drain 35 is arranged so that the inlet port 35*c* does not cross a line segment connecting the center of the communicating hole for drain 31*d* and the center of the strainer 41. Besides, as shown in FIG. 3B, an angle θ between a main flow F1 of oil to the strainer 41 in a position of the communicating hole for drain 31*d* and the central axis C of the pipe base 35*a* is set to approximately 180 degrees (the angle θ means an angle between the main flow F1 and a unit vector which is parallel to the central axis C from the inlet port 35*c* toward the outside of the communicating pipe for drain 35, that is, an angle measured counterclockwise in FIG. 3B from the main flow F1 between the main flow F1 and the central axis C).

In the oil pan 130 provided with such configuration in this embodiment, while the engine 10 is operated, the inlet port 35*c* of the communicating pipe for drain 35 and the communicating hole for drain 31*d* are covered with an external wall of the communicating pipe for drain 35 (the pipe base 35*a*) itself so that they are hidden from a suction opening 41*b* of the strainer 41. That is, the inlet port 35*c* and the communicating hole for drain 31*d* are shielded from an effect (an effect of negative pressure in the suction opening 41) of the main flow F1 of oil to the suction opening 41*b* of the strainer 41. Therefore, an inflow of oil from the second chamber 30*b* into the first chamber 30*a* through the communicating hole for drain 31*d* is restrained.

On the other hand, when oil is removed, oil in the first chamber 30*a* can promptly and securely flow out into the second chamber 30*b* through the communicating pipe for drain 35 provided in the lowest part of the first chamber 30*a*.

Third Embodiment

FIG. 4 are side sectional views for explaining the configuration of a main part of an oil pan 230 in a third embodiment of the present invention.

A circular communicating hole for drain 31*d* is formed in a lowest part of a bottom panel 31*a* of an oil pan separator 31 in the oil pan 230 in this embodiment. A float valve for drain 36 that can close the communicating hole for drain 31*d* from the downside is arranged in the oil pan 230.

The float valve for drain 36 is configured by a base 36*a* arranged immediately under the communicating hole for drain 31*d*, a stopper part 36*b* arranged on the upside of the base 36*a* and a coupling part 36*c* that couples the base 36*a* and the stopper part 36*b*, and these are integrally formed by foamed resin having sufficiently smaller specific gravity than oil.

The base 36*a* is arranged under the bottom panel 31*a* of the oil pan separator 31 and over a bottom panel 32*a* of an oil pan cover 32, that is, in a second chamber 30*b* and under a first chamber 30*a*. The base 36*a* is configured by a cylindrical lower part the bottom of which is a circle having a larger diameter than a diameter of the communicating hole for drain 31*d* and an almost conical upper part formed on the upside of the lower part and is configured so that the communicating hole for drain 31*d* can be closed by touching a conical surface of the upper part to an edge of the communicating hole for drain 31*d* from the downside of the bottom panel 31*a* of the oil pan separator 31.

The stopper part 36*b* is a cylindrical bar member and its length is formed in similar length to a diameter of the bottom of the base 36*a* (at least longer than a diameter of the communicating hole for drain 31*d*). The coupling part 36*c* couples a conical vertex of the upper part of the base 36*a* and the center in a longitudinal direction of the stopper part 36*b*. The length of the coupling part 36*c* is set to an extent that the float valve for drain 36 can be installed on the oil pan separator 31 by inserting the stopper part 36*b* through the communicating hole for drain 31*d* provided to the oil pan separator 31 after the oil pan separator 31 is mounted on a cylinder block 20*a*. Besides, the length of the coupling part 36*c* is set to an extent that the float valve for drain 36 is not touched to the bottom panel 32*a* of the oil pan cover 32 when the float valve for drain 36 is displaced on the downside in FIG. 4 while no oil is stored in the oil pan 230.

Figure 4A:
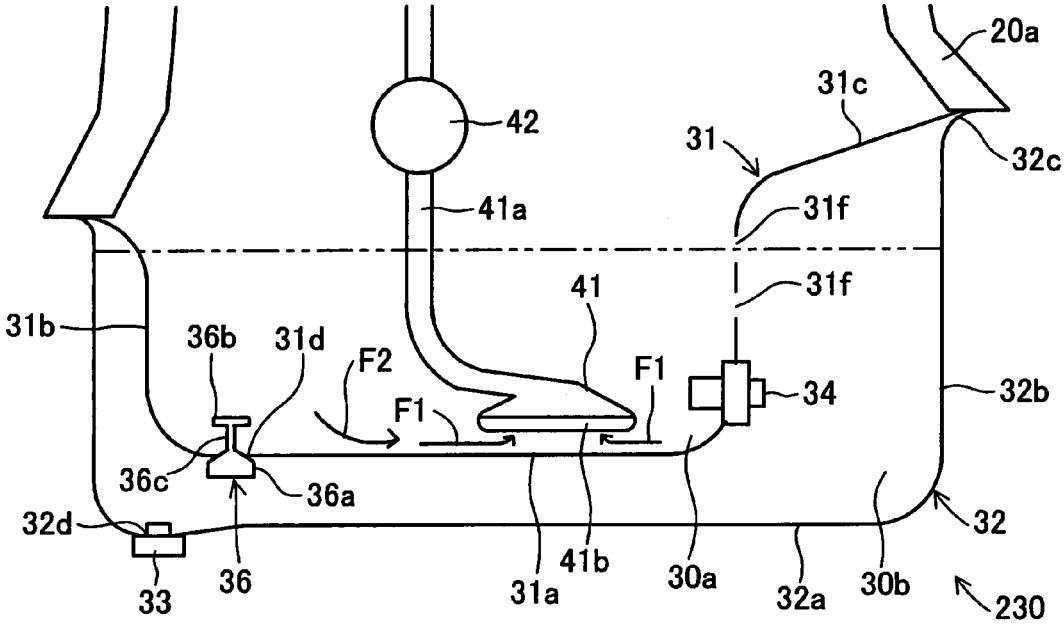
FIG. 4 are schematic diagrams for explaining the configuration of a main part in a third embodiment.

In the oil pan 230 provided with such configuration in this embodiment, as shown in FIG. 4A, when an oil level is located in a higher position than an intermediate position of HALF and EMPTY (in normal operation: FIG. 4A shows a case that an oil level is FULL) while the engine 10 is operated, the float valve for drain 36 is lifted upward in FIG. 4A by buoyancy and the base 36*a* is touched to the bottom panel 31*a* of the oil pan separator 31 from the downside (from the side of the second chamber 30*b*). Hereby, the communicating hole for drain 31*d* is closed because the almost conical upper part of the base 36*a* is fitted to the edge of the communicating hole for drain 31*d*. Therefore, an inflow of oil from the second chamber 30*b* to the first chamber 30*a* through the communicating hole for drain 31 is blocked.

Figure 4B:
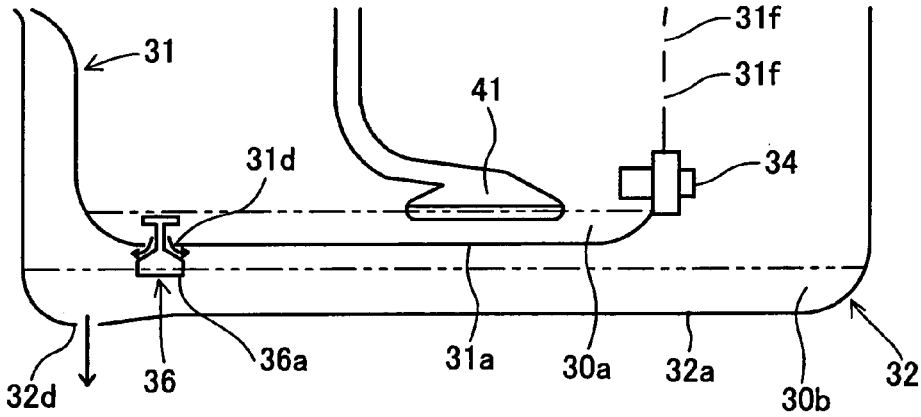

When oil is removed, oil is filled in an area of the second chamber 30*b* on the downside of the bottom panel 31*a* until an oil level in the second chamber 30*b* is lower than the bottom panel 31*a* of the oil pan separator 31. Thereby, buoyancy continues to be applied to the base 36*a* of the float valve for drain 36 in the oil in the area of the second chamber 30*b*. Therefore, while oil in the first chamber 30*a* can flow out into the second chamber 30*b* through an upper communicating hole 31*f* (that is, while an oil level in the first chamber 30*a* is higher than a position in which the upper communicating hole 31*f* is formed), the float valve for drain 36 closes the communicating hole for drain 31*d* from the downside of the bottom panel 31*a* of the oil pan separator 31 by the buoyancy in the oil. Afterward, when the oil level in the first chamber 30*a* reaches a lower end of an edge of an upper communicating hole 31*f* located in a lowest position of plural ones, no oil flows out from the first chamber 30*a* into the second chamber 30*b* through the upper communicating hole 31*f* and only oil in the second chamber 30*b* flows out of a drain plug hole 32*d*. As shown in FIG. 4B, when an oil level in the second chamber 30*b* is low enough and downward oil pressure applied to the float valve for drain 36 by the oil (gravity applied to the oil) in the first chamber 30*a* is larger than the upward buoyancy applied to the float valve for drain 36, the float valve for drain 36 is displaced downward, hereby, the communicating hole for drain 31*d* is opened, and the oil in the first chamber 30*a* can flow out into the second chamber 30*b* through the communicating hole for drain 31*d*. In this case, as the oil in the first chamber 30*a* can flow out into the second chamber 30*b* substantially completely through the communicating hole for drain 31*d* formed in the lowest part of the first chamber 30*a*, that is, the lowest part of the bottom panel 31*a* of the oil pan separator 31, the oil can flow outside through the drain plug hole 32*d* afterward. Therefore, the quantity of residual oil in the first chamber 30*a* when oil is removed can be possibly reduced.

Fourth Embodiment

FIG. 5 are side sectional views for explaining the configuration of a main part of an oil pan 330 in a fourth embodiment of the present invention.

In this embodiment, a communicating hole for drain 31*d* is formed in a first chamber 30*a* of the oil pan 330 and a lowest part of a bottom panel 31*a* of an oil pan separator 31. And a float valve for drain 136 pierces the communicating hole for drain 31*d*.

The float valve for drain 136 is configured by a base 136*a* arranged on the downside of the bottom panel 31*a* of the oil pan separator 31, a float 136*b* arranged on the upside of the bottom panel 31*a* of the oil pan separator 31 (that is, in the first chamber 30*a*) and a coupling member 136*c* which is arranged so that the coupling member pierces the communicating hole for drain 31*d* and couples the base 136*a* and the float 136*b*.

In this embodiment, plural upper communicating holes 31*f* provided to the side panel 31*b* of the oil pan separator 31 are formed in a range from the height of a full oil level (FULL) to the height of the middle of a half oil level (HALF) and an oil level (EMPTY) when the first chamber is empty.

The base 136*a* is made of metal having larger specific gravity than oil and an upper part of the base 136*a* is formed in an almost conical shape having a larger bottom than the communicating hole for drain 31*d*. The float 136*b* is made of foamed resin having smaller specific gravity than oil and is formed so that the float has enough volume to lift the base 136*a* by buoyancy in oil. The coupling member 136*c* is made of wire, and is formed in length to locate a lower end of the float 136*b* at the height of the middle of HALF and EMPTY when the upper part of the base 136*a* is lifted and reaches the highest position (a maximum rise position) so as to be touched to an edge of the communicating hole for drain 31*d* formed at the bottom panel 31*a* and block the communicating hole for drain 31*d*.

Figure 5A:
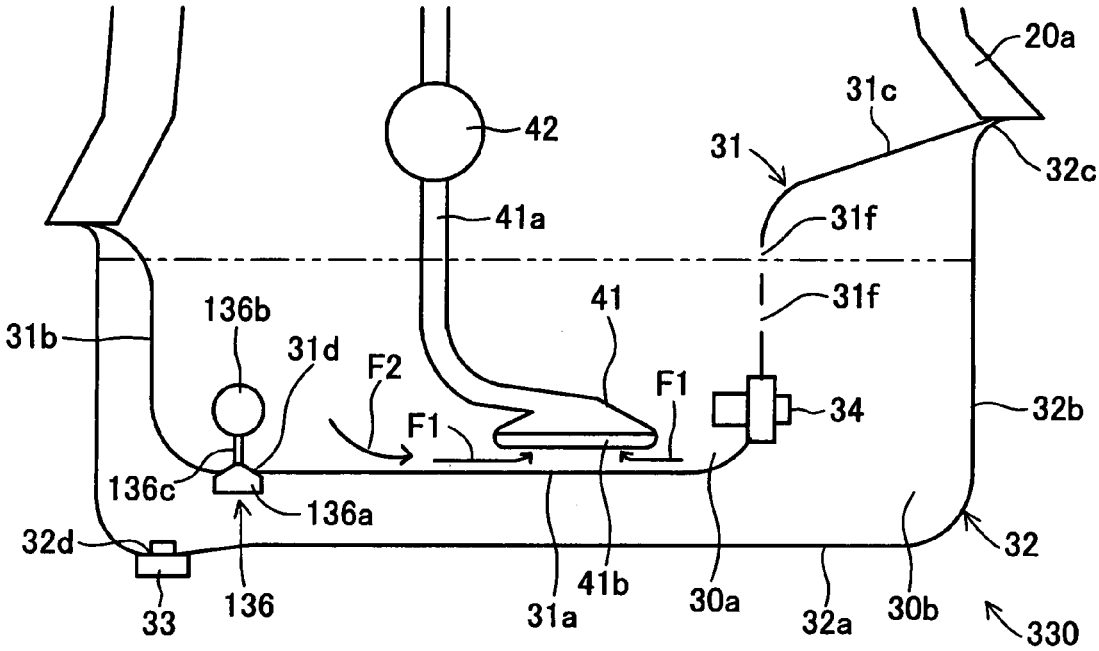
FIG. 5 are schematic diagrams for explaining the configuration of a main part in a fourth embodiment.

In the oil pan 330 provided with such configuration in this embodiment, as shown in FIG. 5A, when an oil level is located on the upside of an intermediate position of HALF and EMPTY (in normal operation: FIG. 5A shows a case that the oil level is the full oil level) while an engine 10 is operated, the float valve for drain 136 is lifted upward in FIG. 5A by the buoyancy of the float 136*b*, the base 136*a* is lifted up to the maximum rise position, and is touched to the bottom panel 31*a* of the oil pan separator 31 from the downside (from the side of a second chamber 30*b*). Hereby, as the almost conical upper part of the base 136*a* is fitted to the edge of the communicating hole for drain 31*d*, the communicating hole for drain 31*d* is closed. Therefore, an inflow of oil from the second chamber 30*b* into the first chamber 30*a* through the communicating hole for drain 31*d* is blocked.

Figure 5B:
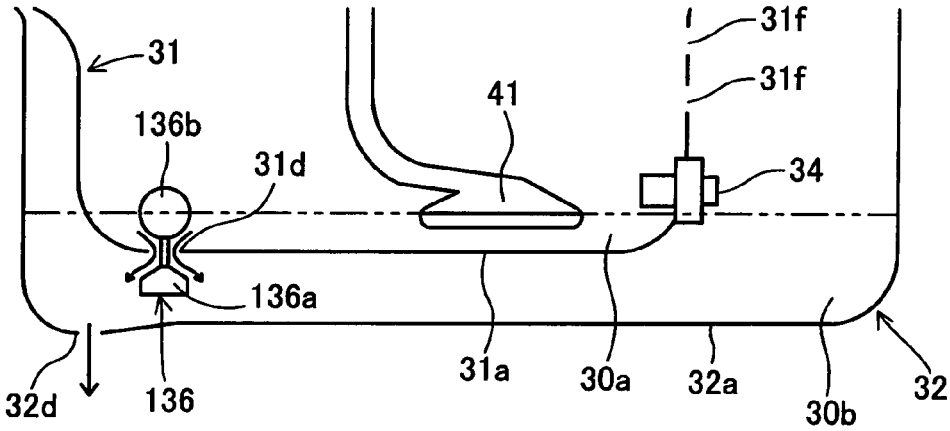

When oil is removed, oil in the first chamber 30*a* flows out into the second chamber 30*b* through the upper communicating holes 31*f* until an oil level in the first chamber 30*a* reaches the height of the middle of HALF and EMPTY. As shown in FIG. 5B, when an oil level in the first chamber 30*a* reaches the downside shown by a chain double-dashed line of the height of the middle of HALF and EMPTY, the base 136*a* is displaced on the downside of the maximum rise position and clearance is made between a top face of the base 136*a* and the edge of the communicating hole for drain 31*d* provided to the lowest part of the first chamber 30*a*. In this case, oil in the first chamber 30*a* can securely flow out into the second chamber 30*b* through the clearance.

In the meantime, even when the engine 10 is operated, an oil level in the first chamber 30*a* may also reach the downside of the intermediate position of HALF and EMPTY in case that only a small quantity of oil is stored in the oil pan 30. In such a case, as the base 136*a* is also displaced on the downside of the maximum rise position, clearance is made between the top face of the base 136*a* and the edge of the communicating hole for drain 31*d* provided to the lowest part of the first chamber 30*a* as shown in FIG. 5B. When only a small quantity of oil is stored in the oil pan 30 as a whole as described above, the end of warming up is never excessively delayed even if all oil in the oil pan 30 is supplied to moving parts in warming up. On the other hand, when the quantity of oil to be supplied to the moving parts for lubrication is limited to only the quantity of oil in the first chamber 30*a*, the quantity of oil to be supplied to the moving parts for lubrication may be short and lubrication in the engine 10 may be not satisfactorily executed. Therefore, in this embodiment, as oil in the second chamber 30*b* through the clearance can also be sucked by a suction opening 41*b* of a strainer 41 during warming up when only a small quantity of oil is stored in the oil pan, the satisfactory lubrication of the engine 10 can be maintained (particularly at the time of temperature equal to or lower than valve opening temperature of a thermo valve apparatus 34 and in starting at extremely low temperature).

Fifth Embodiment

Figure 6A:
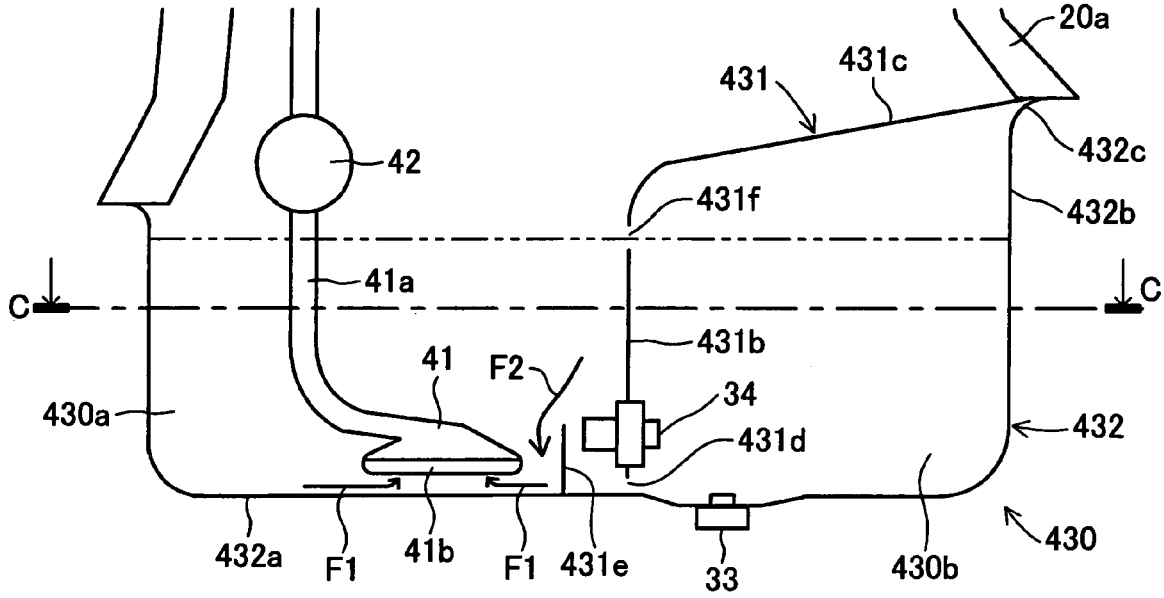
FIG. 6 are schematic diagrams for explaining the configuration of a main part in a fifth embodiment.
Figure 6B:
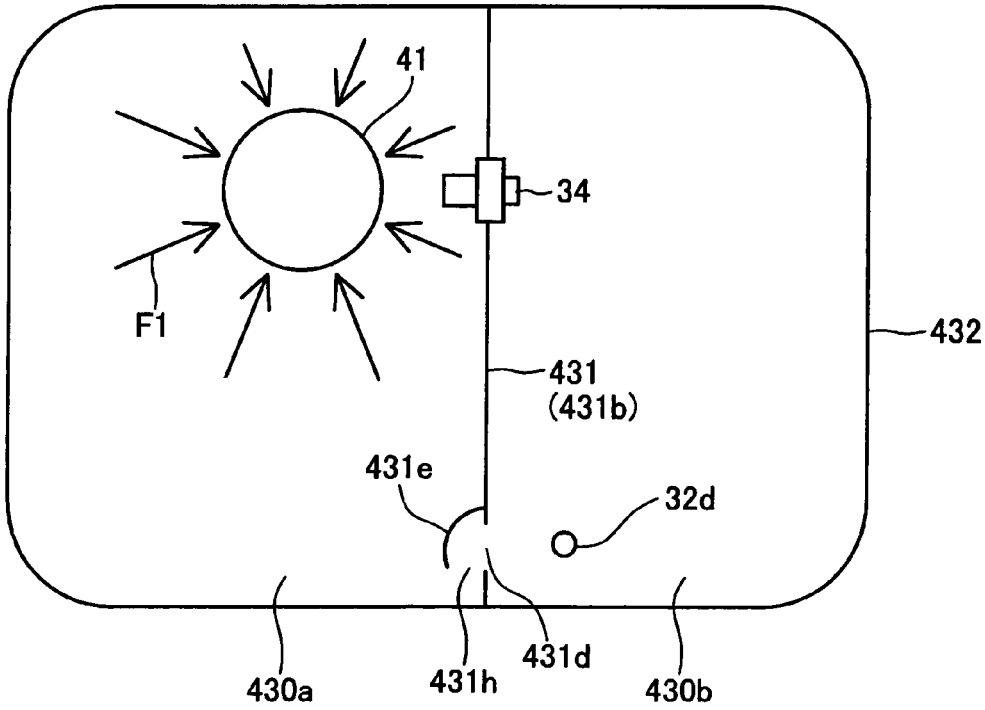

FIG. 6 are schematic diagrams for explaining the configuration of a main part of an oil pan 430 in a fifth embodiment of the present invention, FIG. 6A is a side sectional view, and FIG. 6B is a sectional view viewed along a line C-C in FIG. 6A.

In the oil pan 430 in this embodiment, a first chamber 430*a* and a second chamber 430*b* are formed by dividing the inside of a bathtub type oil pan cover 432 in a horizontal direction (in a lateral direction in FIG. 6B) by an oil pan separator 431.

That is, the oil pan separator 431 is configured by a flat side panel 431*b* and a flange 431*c* connected to an upper end of the side panel 431*b*. The oil pan cover 432 is configured by a bottom panel 432*a*, a side panel 432*b* provided so that the side panel encircles the bottom panel 432*a* and a flange 432*c* provided to a circumference on the upside of the side panel 432*b*. The oil pan separator 431 is arranged so that its side panel 431*b* is touched substantially perpendicularly to the bottom panel 432*a* of the oil pan cover 432.

A communicating hole for drain 431*d* is formed at a lower end of the side panel 431*b* of the oil pan separator 431. An upper communicating hole 431*f* is formed on the upside of the side panel 431*b*. A shielding plate 431*e* is provided to the lower end on the side of the first chamber 430*a* of the side panel 431*b* so that the shielding plate surrounds the upper communicating hole 431*f*. The shielding plate 431*e* is formed in an almost circular arc in a top view, one end is connected to the side panel 431*b* of the oil pan separator 431, and the shielding plate is integrated with the oil pan separator 431. Besides, the shielding plate 431*e* is provided so that a lower end of the shielding plate 431*e* is touched to the bottom panel 432*a* of the oil pan cover 432 substantially overall the length of the almost circular arc. Further, a slit 431*h* as an oil channel which oil can pass is formed at the other end different from the one end connected to the side panel 431*b* of the shielding plate 431*e*. The slit 431*h* is open in a reverse direction to a strainer 41 in the top view, that is, is provided at the end out of both ends of the shielding plate 431*e* farther from the strainer 41.

The specifications of the communicating hole for drain 431*d*, the shielding plate 431*e*, the upper communicating hole 431*f* and the slit 431*h* in this embodiment (that is, a diameter of the holes, slit width, the length of the shielding plate 431*e* in the top view, the height and a formed position) are similar to those in the first embodiment. The material and manufacturing methods of the oil pan separator 431 and the oil pan cover 432 are similar to those of the oil pan separator 31 and the oil pan cover 32 in the first embodiment.

The oil pan 430 provided with the above-mentioned configuration in this embodiment also acts as in the first embodiment. That is, in warming up, the communicating hole for drain 431*d* is substantially shielded from an effect of a main flow F1 generated by negative pressure in the strainer 41 by the shielding plate 431*e* and an inflow of low temperature oil from the second chamber 430*b* into the first chamber 430*a* through the communicating hole for drain 431*d* is possibly restrained. On the other hand, when oil is removed, oil in the first chamber 430*a* can flow out into the second chamber 430*b* through an opening at an upper end of the shielding plate 431*e* and the slit 431*h*. In other words, in this embodiment, positional relation between the first chamber and the second chamber in the first embodiment is changed from the vertical relation to lateral relation.

Sixth Embodiment

Figure 7A:
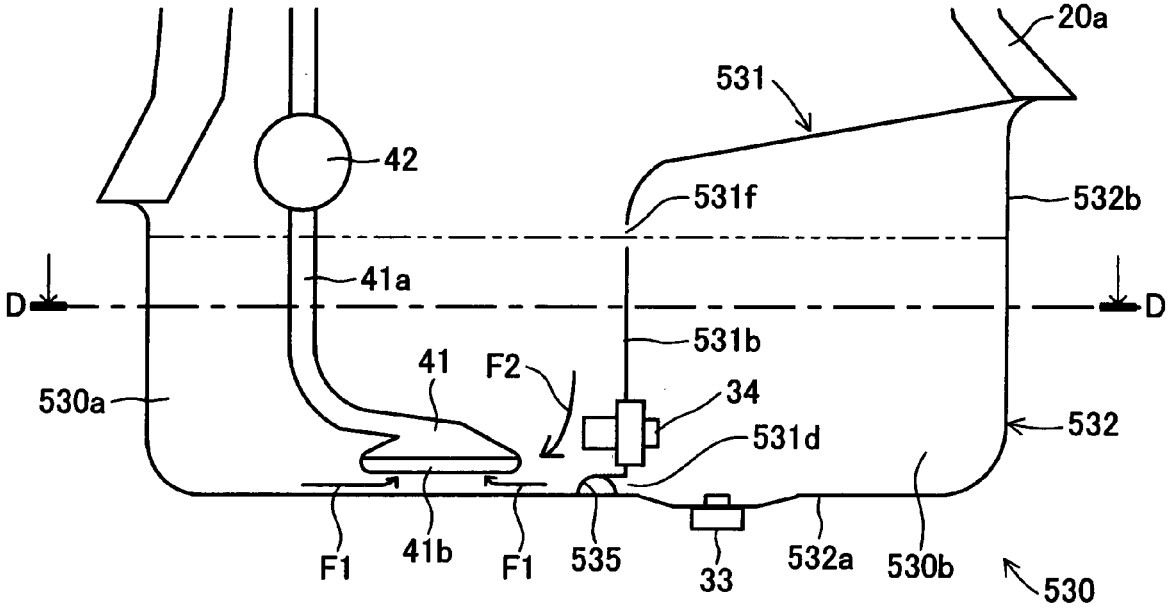
FIG. 7 are schematic diagrams for explaining the configuration of a main part in a sixth embodiment.
Figure 7B:
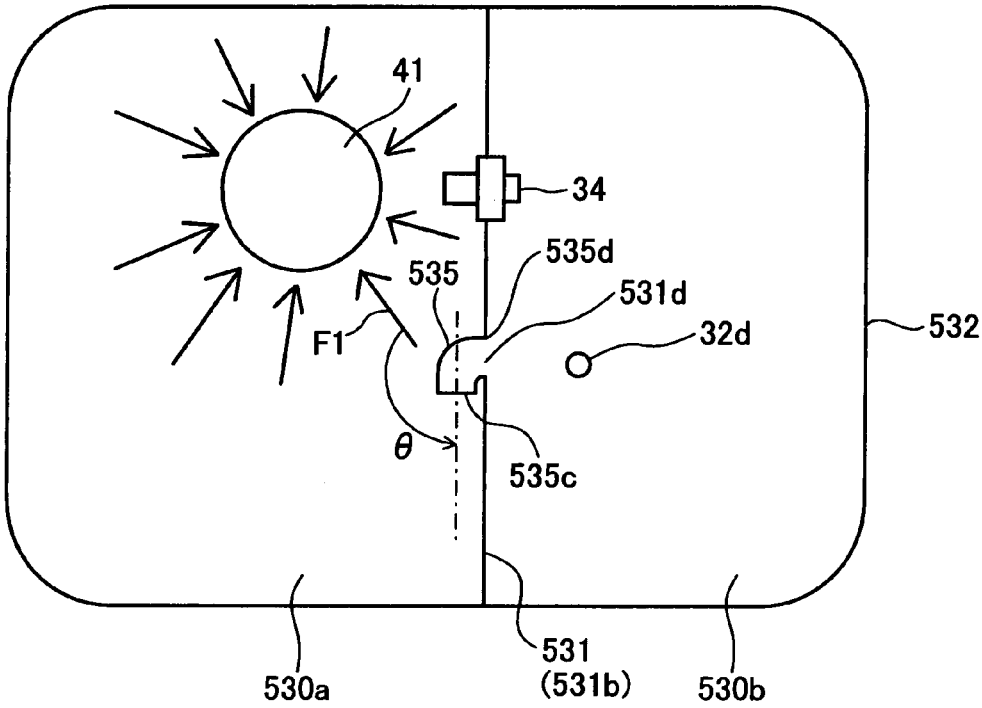

FIG. 7 are schematic diagrams for explaining the configuration of a main part of an oil pan 530 in a sixth embodiment of the present invention, FIG. 7A is a side sectional view, and FIG. 7B is a sectional view viewed along a line D-D in FIG. 7A.

In the oil pan 530 in this embodiment, as in the fifth embodiment, a first chamber 530*a* and a second chamber 530*b* are formed by dividing the inside of a bathtub type oil pan cover 532 in a horizontal direction (in a lateral direction in FIG. 7B) by an oil pan separator 531.

A communicating hole for drain 531*d* is formed at a lower end of a side panel 531*b* of the oil pan separator 531. A communicating pipe for drain 535 is arranged on a bottom panel 532*a* of the oil pan cover 532. The communicating pipe for drain 535 is formed by bending a tubular member having a semicircular section by approximately 90 degrees and a flat bottom forming a diameter of a semicircle of the communicating pipe for drain 535 is touched to the bottom panel 532*a* of the oil pan cover 532.

An inlet port 535*c* at one end of the communicating pipe for drain 535 is open to the first chamber 530*a* and a discharge port 535*d* at the other end connects with the communicating hole for drain 531*d*. The inlet port 535*c* is open in a reverse direction to a strainer 41 in a top view, that is, an angle θ between a main flow F1 from the center of the inlet port 535*c* toward the center of the strainer 41 in the top view and a normal of a plane including the inlet port 535*c* is approximately 90 degrees or larger.

The oil pan 530 provided with the above-mentioned configuration in this embodiment also acts as in the second embodiment. That is, in warming up, the communicating hole for drain 531*d* is substantially shielded from an effect of the main flow F1 generated by negative pressure in the strainer 41 by an external wall of the communicating pipe for drain 535 itself and an inflow of low temperature oil from the second chamber 530*b* into the first chamber 530*a* through the communicating hole for drain 531*d* is possibly restrained. On the other hand, when oil is removed, oil in the first chamber 530*a* can flow out into the second chamber 530*b* through the communicating pipe for drain 535. In other words, in this embodiment, the positional relation between the first chamber and the second chamber in the second embodiment is changed from the vertical relation to lateral relation.

Seventh Embodiment

Figure 8:
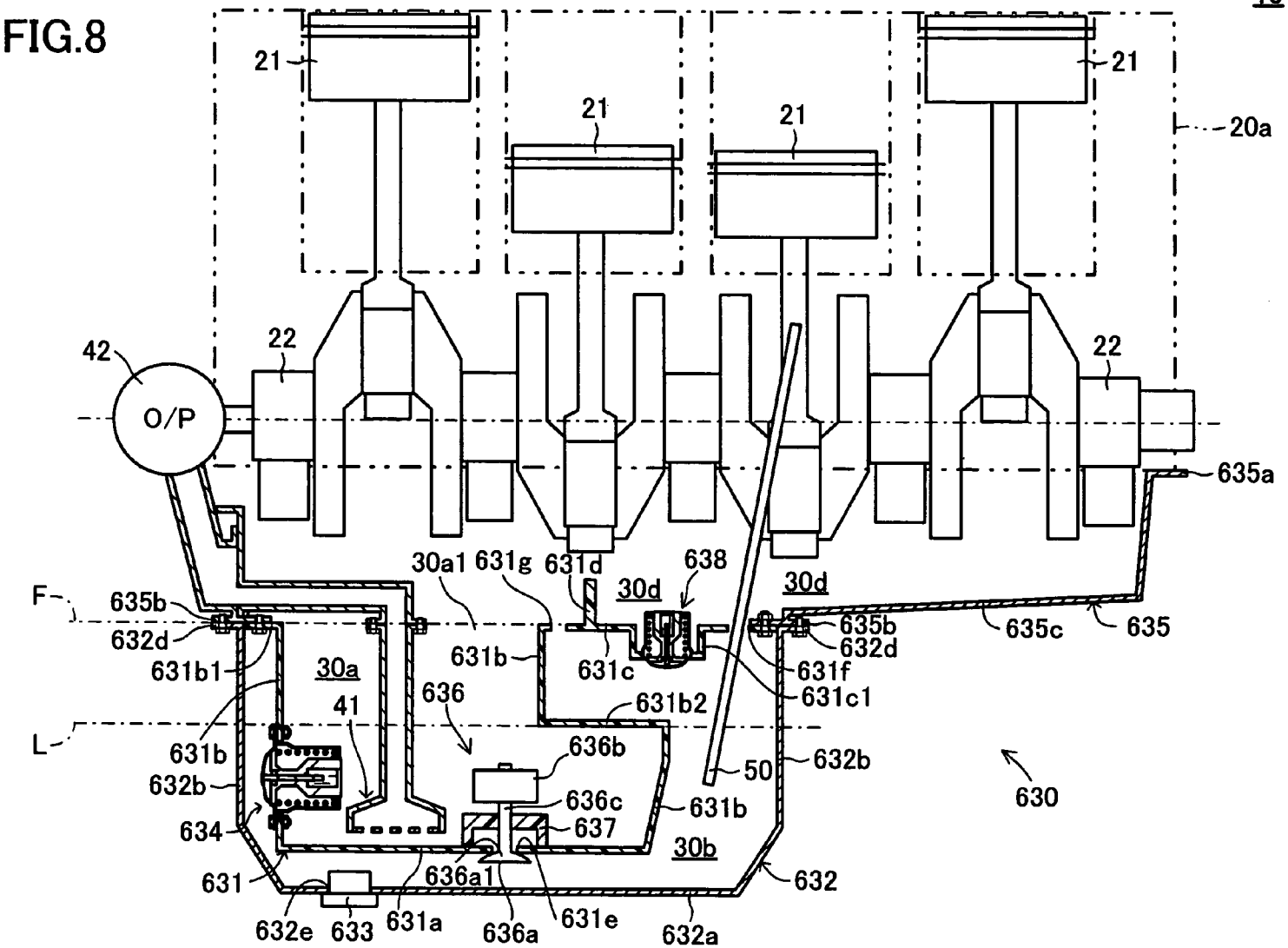
FIG. 8 is a side sectional view for explaining the configuration of a main part in a seventh embodiment.

FIG. 8 is a side sectional view for explaining the configuration of an oil pan 630 in a seventh embodiment of the present invention. Referring to FIG. 8, the configuration of the oil pan 630 in this embodiment will be described below.

The oil pan 630 in this embodiment is provided with an oil pan separator 631 and an oil pan cover 632. The oil pan separator 631 is formed by a bathtub type plate member and is open to a cylinder block 20*a* on the upside. The oil pan cover 632 is formed by a bathtub type plate member and covers the outside of the oil pan separator 631.

As in the above-mentioned each embodiment, a drain plug 633 is installed at a bottom of the oil pan cover 632. A first thermo valve apparatus 634 is configured and arranged like the thermo valve apparatus 34 in the above-mentioned each embodiment. That is, the first thermo valve apparatus 634 is configured so that an oil communicating channel can be formed between a first chamber 30*a* formed by inside space of the oil pan separator 631 and a second chamber 30*b* which is space outside the first chamber and is inside space of the oil pan cover 632. The first thermo valve apparatus 634 is installed at a bottom of a side plate 631*b* described later of the oil pan separator 631.

In this embodiment, a lower case 635 is connected to a lower end of the cylinder block 20*a*. The oil pan separator 631 and the oil pan cover 632 are supported by the lower case 635.

The lower case 635 is a bathtub type member formed so that the lower case is open to the cylinder block 20*a*. The lower case 635 covers the downside of a crankshaft 22 arranged at a lower end of the cylinder block 20*a*. An upper flange 635*a* is formed at an upper edge of the lower case 635 so that the upper flange is substantially horizontally extended outside. The lower case 635 is fixed to the lower end of the cylinder block 20*a* by fixing the upper flange 635*a* to the lower end of the cylinder block 20*a* by bolts and others.

A large through hole is formed at a bottom of the lower case 635 and a lower flange 635*b* for fixing the oil pan separator 631 and the oil pan cover 632 is formed at an open end of the through hole so that the lower flange is substantially horizontally extended in both inside and outside directions. The oil pan cover 632 is mounted on the lower flange 635*b* so that the large through hole at the bottom of the lower case 635 is closed from the downside. The oil pan separator 631 is mounted inside the oil pan cover 632 mounted on the lower flange 635*b*.

A sloped plate 635*c* is formed in a part (a right part in FIG. 8: the same applies hereinafter) close to a power train mechanism not shown of the lower case 635. The sloped plate 635*c* is formed so that the sloped plate receives return oil dropping from the cylinder block 20*a* by the action of gravity and the return oil can be gently delivered toward space (the first chamber 30*a* or the second chamber 30*b*) inside the oil pan cover 632.

((Configuration of Oil Pan Separator))

The oil pan separator 631 is configured by a bottom plate 631*a*, a side plate 631*b*, an upper partition plate 631*c* and a side partition plate 631*d*. The oil pan separator 631 is integrated by synthetic resin having low thermal conductivity.

The side plate 631*b* is provided to a peripheral edge of the bottom plate 631*a* of the oil pan separator 631 so that the side plate surrounds the bottom plate 631*a*. The first chamber 30*a* is substantially formed by space (a first concave portion and a first chamber forming concave portion) surrounded by the bottom plate 631*a* and the side plates 631*b*. The second chamber 30*b* is formed by space which is on the downside and on the side of the first chamber 30*a* and which is surrounded by the oil pan cover 632 and the oil pan separator 631.

An upper end of the side plate 631*b* is arranged at height equivalent to an oil level F. A first chamber opening 30*a*1 open to the cylinder block 20*a* at the upper end of the side plate 631*b* is formed so that the return oil dropping from the cylinder block 20*a* by the action of gravity passes the first chamber opening and can reach the first chamber 30*a*. That is, a first oil refluxing channel that directly refluxes the return oil into the first chamber 30*a* is formed by the first chamber opening 30*a*1.

The first thermo valve apparatus 634 is arranged at the bottom part of the side plate 631*b* of the oil pan separator 631. The first thermo valve apparatus 634 is arranged in a lower position than an oil level L by an oil level gauge 50. A strainer 41 is arranged in the vicinity of the first thermo valve apparatus 634 in a horizontal direction and in the lower position than the first thermo valve apparatus 634.

A flange 631*b*1 is extended outside from the upper edge of the side plate 631*b* of the oil pan separator 631. The flange 631*b*1 is fixed to the lower flange 635*b* substantially horizontally provided to a lower end of the lower case 635 by bolts and nuts.

A flat part 631*b*2 is formed halfway of the part of the side plate 631*b* close to the power train mechanism not shown (opposite to the first thermo valve apparatus 634 on the side plate 631*b* of the oil pan separator 631). The flat part 631*b*2 is extended inside (on the side of the first chamber 30*a*). The flat part 631*b*2 is arranged at the height equivalent to the oil level L. That is, the flat part 631*b*2 is formed so that the oil housing volume of the bottom part of the first chamber 30*a* can be secured by protruding the bottom part (a part equal to or lower than the oil level L) of the first chamber 30*a* on the side of the second chamber 30*b*.

The upper partition plate 631*c* which is a plate member forming an upper limit of the second chamber 30*b* is substantially horizontally arranged on the upside of the flat part 631*b*2. The upper partition plate 631*c* is connected to an upper end of the part close to the power train mechanism not shown of the side plate 631*b* of the oil pan separator 631. That is, the upper partition plate 631*c* is connected to the upper end of the side plate 631*b* connected to an end on the inside of the flat part 631*b*2. An end close to the power train mechanism of the upper partition plate 631*c* is fixed to the lower flange 635*b* on the inside of the lower case 635 by bolts and nuts as the flange 631*b*1.

The side partition plate 631*d* is planted upward from the upper partition plate 631*c*. A return oil reservoir 30*d* as a third concave portion (a third concave portion different from the concave portion surrounded by the oil pan separator 631 and the concave portion surrounded by the oil pan cover 632) in the oil pan 630 is formed by space encircled by the side partition plate 631*d*, the upper partition plate 631*c* and the lower case 635.

Such a return oil reservoir 30*d* is formed so that the return oil refluxed from the part close to the power train mechanism not shown in the cylinder block 20*a* by the action of gravity can be once reserved. The upper partition plate 631*c* partitions an upper part of the second chamber 30*b* and the return oil reservoir 30*d*. The side partition plate 631*d* regulates one end of the return oil reservoir 30*d* in a longitudinal direction of an engine (in a longitudinal direction of the crankshaft 22).

A drain hole 631*e* that forms a communicating opening in the present invention is formed piercing the bottom plate 631*a* of the oil pan separator 631. That is, the drain hole 631*e* is formed in a lowest position of the first chamber 30*a*. The drain hole 631*e* is formed in a circle of size (for example, approximately 20 mm in diameter) enough to outpour even low temperature oil (for example, approximately 0° C.) having high viscosity to the outside the first chamber 30*a* (to the side of the second chamber 30*b*). A float valve 636 is installed through the drain hole 631*e*. The detailed configuration of the float valve 636 will be described later.

A level gauge supporting hole 631*f* is formed around the end (in the vicinity of the lower flange 635*b* on the inside of the lower case 635) close to the power train mechanism of the upper partition plate 631*c*. The level gauge supporting hole 631*f* is formed in a highest position of the second chamber 20*b*. The level gauge supporting hole 631*f* is formed so that the upper part of the second chamber 30*b* and the return oil reservoir 30*d* communicate.

The level gauge supporting hole 631*f* is formed so that the tip end of the oil level gauge 50 can be inserted. The level gauge supporting hole 631*f* is formed in such a shape that narrow clearance having predetermined width is formed between the level gauge supporting hole and the oil level gauge 50 when the oil level gauge 50 is inserted. The narrow clearance having the predetermined width means clearance which low temperature oil having high viscosity in warming up cannot easily pass, while the narrow clearance having the predetermined width means clearance which relatively high temperature (for example, approximately 60° C.) oil having low viscosity in the vicinity of valve opening temperature in the first thermo valve apparatus 634 easily passes.

That is, in this embodiment, the level gauge supporting hole 631*f* is formed so that high temperature return oil after warming up is finished can be refluxed from the return oil reservoir 30*d* into the upper part of the second chamber 30*b*. The level gauge supporting hole 631*f* is formed in a position opposite to the first thermo valve apparatus 634 arranged at one end of the first chamber 30*a* in the longitudinal direction of the engine (in the longitudinal direction of the crankshaft 22) and distant from the first thermo valve apparatus 634 (a position close to the other end of the first chamber 30*a* in the longitudinal direction of the engine).

The level gauge supporting hole 631*f* is formed so that an oil suction pipe provided in an oil changer on the market for enabling sucking oil when the whole oil is discharged from the oil pan 630 can be inserted. Further, the level gauge supporting hole 631*f* is formed so that an oil injection pipe for injecting fresh oil into the oil pan 630 can be inserted.

In a part outside the return oil reservoir 30*d* (outside the side partition plate 631*d*) of the upper partition plate 631*c*, a through hole 631*g* is formed. The through hole 631*g* communicates with the second chamber 30*b*. The through hole 631*g* is formed so that return oil which gets over the side partition plate 631*d* and overflows from the return oil reservoir 30*d* can be refluxed into the second chamber 30*b* after the return oil is once received by the return oil reservoir 30*d*.

A second thermo valve apparatus 638 is mounted on a concave part of the upper partition plate 631*c*, piercing the upper partition plate 631*c*. The second thermo valve apparatus 638 is mounted on a concave portion 631*c*1 for mounting the second thermo valve apparatus formed on the upper partition plate 631*c*. The concave portion 631*c*1 for mounting the second thermo valve apparatus is protruded on the side of the second chamber 30*b* and is formed as a concave portion open to the cylinder block 20*a*. That is, a lowest position of the return oil reservoir 30*d* is formed by the bottom of the concave portion 631*c*1 for mounting the second thermo valve apparatus.

The second thermo valve apparatus 638 is provided with the similar configuration to the first thermo valve apparatus 634. That is, the second thermo valve apparatus 638 can stream return oil from the return oil reservoir 30*d* into the second chamber 30*b* at a stroke by opening the valve when the temperature of the return oil temporarily reserved in the return oil reservoir 30*d* reaches predetermined high temperature (for example, 60° C.).

In this embodiment, the second thermo valve apparatus 638 is opened later than the first thermo valve apparatus 634.

The oil pan 630 in this embodiment is configured so that approximately 50 to 70% of openings at the lower end of the cylinder block 20*a* are opposite to the return oil reservoir 30*d* and the sloped plate 635*c*. That is, the shape of the oil pan separator 631 (the shape of the first chamber opening 30*a*1 and the shape and the position of the side partition plate 631*d*) is suitably set so that approximately 50 to 70% of return oil is once received by the return oil reservoir 30*d*, a part of which may flow into the first chamber 30*a* or into the second chamber 30*b* over the side partition plate 631*d*.

That is, the quantity reserved in the return oil reservoir 30*d* of return oil depends upon the dimension (particularly the height) and the shape of the side partition plate 631*d*. Then, in this embodiment, the dimension and the shape of the side partition plate 631*d* are suitably set to be the reserved quantity of return oil in which oil can be satisfactorily circulated in the cylinder block 20*a* and the oil pan 630 in all operational conditions of the engine 10.

Concretely, the side partition plate 631*d* is set to height to some extent so that the oil circulation between the first chamber 30*a* and the second chamber 30*b* in the oil pan 630 is more active after warming up is finished by streaming a large quantity of return oil to some extent into the second chamber 30*b* when the second thermo valve apparatus 638 is opened.

At the same time, the side partition plate 631*d* is set so that it is not too high so as to prevent the quantity of oil in the first chamber 30*a* from being short in cold starting (particularly in starting under extremely low temperature environment). Besides, the side partition plate 631*d* is set so that it is not too high so that warming up can be suitably accelerated by refluxing return oil of suitable quantity into the first chamber 30*a* in warming up.

That is, in this embodiment, a second oil refluxing channel for refluxing return oil into the second chamber 30*b* is configured by the level gauge supporting hole 631*f*, the through hole 631*g* and the second thermo valve apparatus 638.

((Configuration of Oil Pan Cover))

The oil pan cover 632 is a member forming a lower cover of the oil pan 630 and is integrated by pressing a steel sheet.

A side plate 632*b* is provided at a peripheral edge of a bottom plate 632*a* of the oil pan cover 632 with the side plate surrounding the bottom plate 632*a*. The oil pan cover 632 can store oil in space surrounded by the bottom plate 632*a* and the side plate 632*b*. A drain plug hole 632*e* is provided to the bottom plate 632*a* located at the bottom of the space. A thread is formed in the drain plug hole 632*e*. The drain plug 633 can be screwed into the drain plug hole 632*e*.

The oil pan cover 632 is formed so that oil can smoothly flow down to the drain plug hole 632*e* on the bottom plate 632*a* and the side plate 632*b* by the action of gravity. That is, the whole oil stored in the space inside the oil pan cover 632 can flow outside the oil pan 630 through the drain plug hole 632*e* by the action of gravity by removing the drain plug 633 from the drain plug hole 632*e*.

A flange 632*d* is formed at a peripheral edge of an upper end of the side plate 632*b* of the oil pan cover 632. The flange 632*d* is planted so that it is extended outside from the upper end of the side plate 632*b*. The flange 632*d* is formed so that the flange can be bonded to the lower flange 635*b* formed at the lower end of the lower case 635.

((Configuration of Float Valve))

The float valve 636 is provided with the similar configuration to the float valve for drain 136 (see FIG. 5) in the oil pan 330 in the fourth embodiment and is configured by a valve element 636*a*, a float 636*b* and a coupling bar 636*c*.

The valve element 636*a* is arranged on the side of the second chamber 30*b*. The valve element 636*a* is formed so that it can close the drain hole 631*e* from the downside when the valve element is touched to the bottom plate 631*a* of the oil pan separator 631.

The float 636*b* is arranged in the first chamber 30*a* and is made of material having smaller specific gravity than oil. The float 636*b* is arranged on the side of the first chamber 30*a* and opposite to the valve element 636*a* across the drain hole 631*e*.

The coupling bar 636*c* is a member for coupling the valve element 636*a* and the float 636*b* and is arranged substantially vertically.

In this embodiment, a valve surface 636*a*1 which is an upper surface of the valve element 636*a* and is opposite to the drain hole 631*e* is formed to be a spherical surface convex outside. The float valve 636 is formed so that the valve surface 636*a*1 is in satisfactory close contact with an open end of the drain hole 631*e* even if the float valve 636 is inclined when enough quantity of oil is housed in the first chamber 30*a* and the float valve 636 is located in an upper position (a position of the float valve 636 equivalent to a state in which the valve element 636*a* is touched to the drain hole 631*e*) shown in FIG. 8.

A float guide member 637 is fixed to an upper surface (a surface on the side of the first chamber 30*a*) of the bottom plate 631*a* of the oil pan separator 631 in the vicinity of the drain hole 631*e*. The float guide member 637 is arranged opposite to the coupling bar 636*c* of the float valve 636. The float guide member 637 surround the coupling bar 636*c* and can restrain the inclination of the float valve 636 by guiding vertical motion of the coupling bar 636*c*.

Concretely, the float guide member 637 is provided with a guide plate 637*a* surrounding the coupling bar 636*c* of the float valve 636 and plural legs 637*b* planted downward from the guide plate 637*a*. The float guide member 637 is configured so that oil can communicate between the first chamber 30*a* and the second chamber 30*b* through the drain hole 631*e* and space on the downside of the guide plate 637*a* and between the plural legs 637*b* when the float valve 636 is moved downward and the drain hole 631*e* is released.

((Description of Operation))

When the engine 10 in this embodiment is started, an oil pump 42 is operated by the rotation of the crankshaft 22. Hereby, oil in the first chamber 30*a* is supplied to a lubricated mechanism including a piston 21 and the crankshaft 22 via the strainer 41.

In warming up, the first thermo valve apparatus 634 including the oil communicating channel between the first chamber 30*a* and the second chamber 30*b* is closed (the oil communicating channel is closed). Therefore, an oil level in the first chamber 30*a* lowers and is lower than an oil level of the second chamber 30*b*.

In a short time since starting, return oil is refluxed from the lubricated mechanism to the oil pan 630 by the action of gravity. A part of the return oil directly flows into the first chamber 30*a* through the first chamber opening 30*a*1. The temperature of oil in the first chamber 30*a* rises by the return oil directly refluxed into the first chamber 30*a* and the proceedings of warming up are accelerated.

The rest except the part directly flowing into the first chamber 30*a* of the return oil is once received by the return oil reservoir 30*d*. That is, the return oil flows into the return oil reservoir 30*d* directly from the lubricated mechanism or after the return oil is once received by the sloped plate 635*c* of the lower case 635. While the temperature of the return oil flowing into the return oil reservoir 30*d* does not reach the predetermined high temperature (for example, approximately 60° C.), the second thermo valve apparatus 638 is closed. In this case, the return oil is temporarily reserved in the return oil reservoir 30*d*.

Even when the second thermo valve apparatus 638 is closed, the return oil that overflows from the return oil reservoir 30*d* can flow out on the side of the upper partition plate 631*c* outside the return oil reservoir 30*d* over the side partition plate 631*d*. The return oil flowing out is refluxed into the first chamber 30*a* via the first chamber opening 30*a*1 and is refluxed into the second chamber 30*b* via the through hole 631*g*. Therefore, even when the second thermo valve apparatus 638 is closed, a part of the return oil is refluxed into the second chamber 30*b*. Hereby, in warming up and before the second thermo valve apparatus 638 is opened, the difference between oil levels in the first chamber 30*a* and in the second chamber 30*b* may increase, compared with difference immediately after starting.

When the temperature of oil in the first chamber 30*a* reaches predetermined temperature in the first thermo valve apparatus 634, warming up is finished. That is, the first thermo valve apparatus 634 forming the oil communicating channel between the first chamber 30*a* and the second chamber 30*b* is opened (the oil communicating channel between the first chamber 30*a* and the second chamber 30*b* communicates). Hereby, negative pressure caused by the strainer 41 and differential pressure based upon difference in an oil level between the first chamber 30*a* and the second chamber 30*b* have an effect on the oil communicating channel in the first thermo valve apparatus 634 formed in the vicinity of the strainer 41. Hereby, oil in the second chamber 30*b* flows into the first chamber 30*a* via the oil communicating channel formed in the first thermo valve apparatus 634.

Further, when the temperature of return oil reserved in the return oil reservoir 30*d* reaches the predetermined high temperature, the second thermo valve apparatus 638 is opened. Then, a relatively large quantity of return oil reserved in the return oil reservoir 30*d* flows into the second chamber 30*b* at a stroke via the second thermo valve apparatus 638. Hereby, oil is supplied to the upper part of the second chamber 30*b* on the reverse side to the first thermo valve apparatus 634 and an oil level in the second chamber 30*b* temporarily rises. The difference in an oil level between the second chamber 30*b* and the first chamber 30*a* from which oil is ordinarily sucked via the strainer 41 is increased by the supply of oil to the upper part of the second chamber 30*b* (the momentary rise of the oil level of the second chamber 30*b*). That is, difference of oil pressure (differential pressure) because of which oil flows from the second chamber 30*b* into the first chamber 30*a* is made in the vicinity of the first thermo valve apparatus 634.

Therefore, oil in the second chamber 30*b* vigorously flows into the first chamber 30*a* via the oil communicating channel formed in the first thermo valve apparatus 634. Hereby, the whole quantity of oil in the oil pan 630 can be more satisfactorily circulated.

In the oil pan 630 in this embodiment, the level gauge supporting hole 631*f*, the through hole 631*g* and the second thermo valve apparatus 638 respectively configuring the second oil refluxing channel are arranged in higher positions than the first thermo valve apparatus 634. Hereby, an oil level in the second chamber 30*b* in warming up can be possibly made higher than an oil level in the first chamber 30*a*. Therefore, pressure difference between the first chamber 30*a* and the second chamber 30*b* when warming up is finished can be more increased.

Besides, in the oil pan 630 in this embodiment, the first thermo valve apparatus 634 is arranged at the bottom part of the first chamber 30*a* on the reverse side to the second oil refluxing channel. Accordingly, oil in the second chamber 30*b* flows into the first chamber 30*a* via the first thermo valve apparatus 634 arranged in a position distant from a location where an oil level in the second chamber 30*b* rises by refluxing return oil. Therefore, according to the configuration in this embodiment, the circulation of oil in the oil pan 630 after warming up is finished is more active.

In the oil pan 630 in this embodiment, when the quantity of oil in the first chamber 30*a* is sufficient, the float valve 636 is located in the upper position. Therefore, the drain hole 631*e* is blocked by the valve surface 636*a*1 which is the upper surface of the float valve 636.

In this embodiment, the float guide member 637 is provided opposite to the float valve 636 (the coupling bar 636*c*). Hereby, even if a vehicle is driven and oil is moved in starting, stopping, turning and ascending or descending a slope, the inclination of the float valve 636 is restrained. And the valve surface 636*a*1 is formed to be a spherical surface convex outside. Therefore, even if oil is moved and the float valve 636 is slightly inclined, the spherical valve surface 636*a*1 is satisfactorily made contact closely with the circular drain hole 631*e* by the buoyancy of the float 636*b*. Hereby, particularly in warming up, oil in the drain hole 631*e* can be satisfactorily sealed.

On the other hand, in the extreme lowering of an oil level in the first chamber 30*a* which may be caused in such cases as immediately after starting at extremely low temperature, the float valve 636 lowers. Hereby, oil in the second chamber 30*b* can be supplied to the first chamber 30*a* via the drain hole 631*e*. When the whole quantity of oil in the oil pan 630 is discharged outside for an oil change, the whole quantity of oil in the first chamber 30*a* can be promptly discharged outside because the drain hole 631*e* formed in a relatively large diameter is released by the float valve 636.

Besides, in the oil pan 630 in this embodiment, it can be smoothly performed owing to the level gauge supporting hole 631*f* to support the oil level gauge 50 and to replace oil.

Further, in the oil pan 630 in this embodiment, when fresh oil is injected into the oil pan 630, air in the second chamber 30*b* is exhausted upward through the level gauge supporting hole 631*f*. That is, the level gauge supporting hole 631*f* functions as an air vent for exhausting air in the second chamber 30*b*. Here, in this embodiment, the level gauge supporting hole 631*f* is formed in the highest position in the second chamber 30*b*. Accordingly, when fresh oil is injected into the oil pan 630, air is securely exhausted from the upper part of the second chamber 30*b*. Therefore, oil of predetermined quantity can be securely injected into the oil pan 630.

Suggestion of Modification to the Embodiments

The above-mentioned embodiments are only instances embodying the present invention which the applicant thought best when this application was to be filed as described above, the present invention is not limited to the above-mentioned each embodiment, and naturally, various modifications are allowed so long as the essential part of the present invention is unchanged. Some modifications will be described below. However, it is needless to say that a modification is not limited to the following.

In the description of the following modifications, the reference numerals used in the above-mentioned embodiments can be suitably referred. A common reference numeral with each embodiment and plural modifications is allocated to a component having the similar configuration, the similar action and the similar function. As for such a component, the above-mentioned description of the configuration, the action, the function respectively described above can be used for the later description of the component in the modifications unless the description technically contradicts.

For example, the configuration of the oil pan and the lubricating device according to the present invention can also be applied to various devices provided with the lubricating device to which the oil pan is applied such as an automatic transmission in addition to the engine in the above-mentioned each embodiment.

In the first embodiment, the shielding plate 31*e* planted at the bottom panel 31*a* of the oil pan separator 31 is provided between the communicating hole for drain 31*d* and the strainer 41. However, as the strainer 41 and the communicating hole for drain 31*d* are arranged in diagonal positions at the bottom portion of the almost rectangular first chamber 30*a* in the top view and both are located possibly distantly, the effect of negative pressure caused at the suction opening 41*b* of the strainer 41 in warming up is possibly reduced in the position of the communicating hole for drain 31*d*. That is, oil flows into the bottom part of the first chamber 30*a* from the bottom part of the second chamber 30*b* due to the negative pressure according to a configuration in which the shielding plate 31*e* is removed from the configuration in the first embodiment, though a rate of the inflow can be restrained. Accordingly, even if the shielding plate 31*e* is omitted from the configuration in the first embodiment (that is, the shielding plate 31*e* is not provided), the predetermined action and effect of prompt oil discharge and the reduction of warming up time to some extent can be produced.

Besides, the shape of the shielding plate 31*e*, the number, the shapes and the positions of the slits 31*h* in the first embodiment can also be suitably changed.

For example, the shielding plate 31*e* is formed as a plate member separate from the oil pan separator 31 and may also be fixed to the oil pan separator 31 by an adhesive and others, however, it is desirable that both are integrated because impurities such as a component of the adhesive are not mixed in oil. Besides, the shielding plate 31*e* may also be diagonally planted in stead of being perpendicular to the bottom panel 31*a* of the oil pan separator 31. Another plate member for covering an upper part of the shielding plate 31*e* may also be provided to the upper end of the shielding plate 31*e*. Further, the shielding plate 31*e* may also be formed in the shape of a dome or a box respectively having an opening at a lower end.

The width of the shielding plate 31*e* is not necessarily required to completely shield the communicating hole for drain 31*d* from the suction opening 41*b* of the strainer 41 as in the first embodiment (that is, for the whole width of the area R in the vicinity of the communicating hole for drain 31*d* to cross the shielding plate 31*e* as shown in FIG. 2B), and for example, the width of the shielding plate may also be set to width enough for approximately a half of the whole width of the area R to cross the shielding plate 31*e*. When the width of the shielding plate 31*e* is narrowed as described above, it is desirable that the shielding plate 31*e* is arranged on a line connecting the center of the communicating hole for drain 31*d* and the center of the suction opening 41*b* of the strainer 41 in the top view.

Besides, the shape of the slits 31*h* may also be V-shaped or U-shaped (in a shape in which width of the slits is wider toward upper ends of the slits) for example in stead of being parallel or may also be inverted V-shaped and inverted U-shaped (in a shape in which the upper ends of the slits is closed). The slit 31*h* may also be formed at only one end in a direction of the width of the shielding plate 31*e*. Besides, the slit 31*h* may also be provided to the shielding plate 31*e*. In other words, the shielding plate 31*e* may also be divided into a plurality by the slit 31*h*. In this case, an outermost one out of parts divided into plurals of the shielding plate 31*e* may also be coupled to the side panel 31*b*.

Besides, one or more through holes or slits (for example, through holes approximately 1 mm in diameter or slits approximately 1 mm in width) respectively having an opening of enough size for high temperature oil after warming up is finished to pass though low temperature oil cannot pass may also be provided to the shielding plate 31*e*. Besides, the shielding plate 31*e* may also be formed by a mesh member having a fine mesh opening enough for high temperature oil after warming up is finished to pass though low temperature oil cannot pass. Besides, the shielding plate 31*e* is formed by plural plate members and the vicinity of the communicating hole for drain 31*d* may also be labyrinthine by planting the plural plate members around the communicating hole for drain 31*d*.

In the second embodiment, the angle θ between the central axis C of the pipe base 35*a* and the direction F of the oil flow to the strainer 41 in the communicating hole for drain 31*d* is set to approximately 180 degrees. However, the angle may be in the range from 20 degrees to 340 degrees (including 20 degrees and 340 degrees). It is preferable that the angle θ is set to the range from 45 to 315 degrees (including 45 degrees and 315 degrees) and it is preferable that the angle is set to the range from 90 to 270 degrees (including 90 degrees and 270 degrees). However, as shown in FIG. 3 in the second embodiment, as the almost whole length of the pipe base 35*a* is provided so that it is touched to the bottom panel 31*a* even if the angle θ is set to 0 degree, the discharge port 35*d* (the communicating hole for drain 31*d*) can be shielded to some extent from the suction opening 41*b* of the strainer 41 by the external wall of the pipe base 35*a*. Accordingly, even if the angle θ is set to 0 degree, an oil inflow from the bottom part of the second chamber 30*b* into the first chamber 30*a* through the communicating hole for drain 31*d* in warming up can be restrained to some extent. Besides, the pipe base 35*a* of the communicating pipe for drain 35 may also be bent along the bottom panel 31*a* of the oil pan separator 31. Besides, the pipe base 35*a* may also be trumpet-shaped (may also be widened toward the end).

The shape and the structure of the float valve for drain 36 in the third embodiment are also not limited to the above-mentioned configuration. Whole of the float valve for drain 136 in the fourth embodiment may also be made of the same material having smaller specific gravity than oil. Besides, the formed positions of the upper communicating holes 31*f* in the fourth embodiment range from the FULL oil level to intermediate height of the HALF oil level and the EMPTY oil level. This may also be applied to other embodiments.

The shielding plate 431*e* in the fifth embodiment is planted from the side panel 431*b* of the oil pan separator 431. However, it may also be planted from the bottom panel 432*a* of the oil pan cover 432.

Besides, both the communicating pipe for drain 35 (535) and the shielding plate 31*e* (431*e*) can be provided together. For example, in FIG. 3, a shielding plate (a shielding member) may also be provided opposite to the inlet port 35*c* which is an opening on the side of the first chamber 30*a* of the communicating pipe for drain 35. In this case, the angle θ may also be 0 degree. Besides, in FIG. 7, a shielding plate (a shielding member) may also be provided opposite to the inlet port 535*c* which is an opening on the side of the first chamber 530*a* of the communicating pipe for drain 535 and/or the discharge port 535*d* which is an opening on the side of the second chamber 530*b*.

Various configurations may be adopted besides the configuration of the float valve 636 and the circumference shown in FIG. 8 in the seventh embodiment.

Figure 9A:
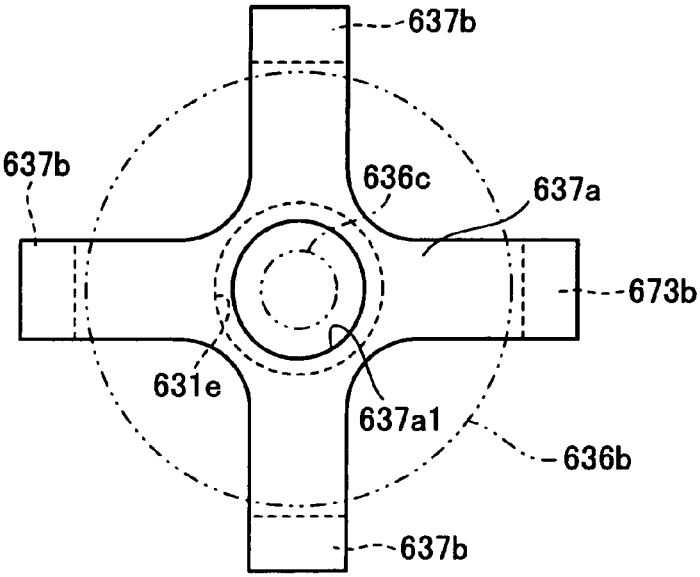
FIG. 9A is a plan.
Figure 9B:
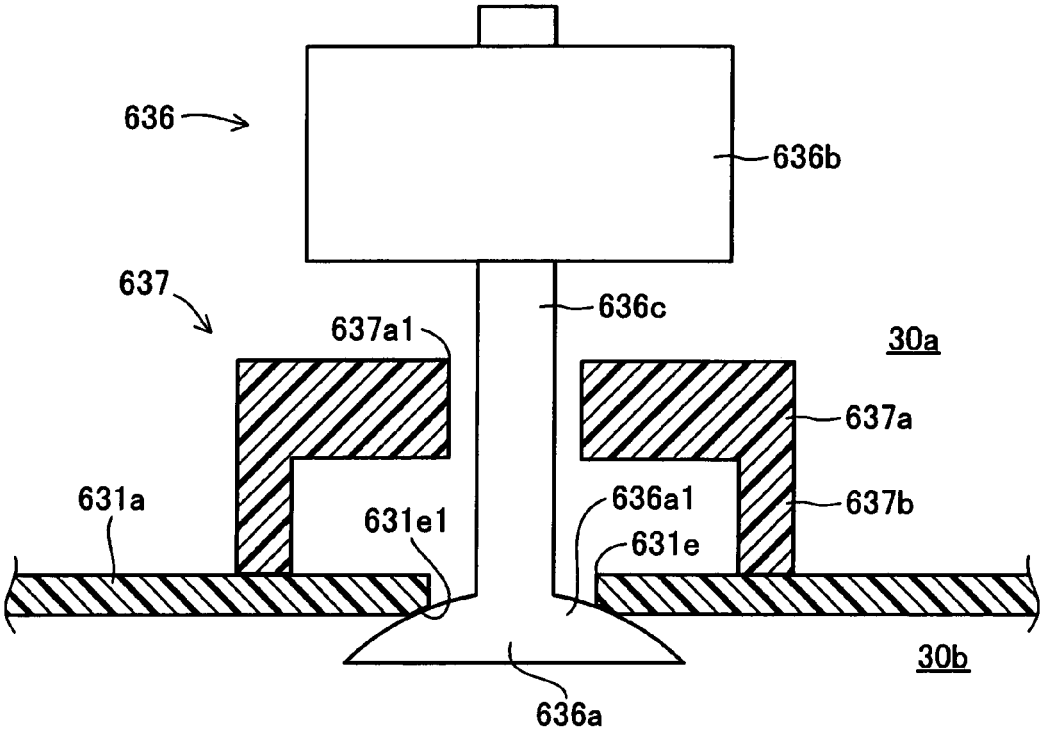
FIG. 9B is a side sectional view.

FIG. 9 show one example of the concrete configuration of the circumference of the float valve shown in FIG. 8, FIG. 9A is a plan, and FIG. 9B is a side sectional view. In FIG. 9A, each member forming a float valve 636 is shown by a chain double-dashed line so that the configuration of a float guide member 637 can be easily grasped.

As shown in FIG. 9B, when a valve surface 636*a*1 of a valve element 636*a* of the float valve 636 is spherical, the limitation (the cutoff) of the communication of oil between a first chamber 30*a* and a second chamber 30*b* is not greatly deteriorated by the inclination of the float valve 636 as described above. Accordingly, in this case, as shown in FIGS. 9A and 9B, clearance between a guide hole 637*a*1 formed piercing a guide part 637*a* of the float guide member 637 and an outside face of a coupling bar 636*c* can be set to a relative large value (for example, approximately 5 mm).

According to such configuration, vertical motion according to a change of an oil level in the first chamber 30*a* of the float valve 636 can be extremely smoothly made. Particularly, when the whole quantity of oil is discharged from the first chamber 30*a* and the second chamber 30*b*, the oil can be extremely smoothly discharged.

As shown in FIG. 9B, a valve element contact surface 631*e*1 may also be formed at a lower end of a drain hole 631*e* formed piercing a bottom plate 631*a* of an oil pan separator 631. The valve element contact surface 631*e*1 is a surface opposite to the valve surface 631*a*1 of the valve element 636*a* and can be formed to be a conical surface or a spherical surface. When the valve element contact surface 631*e*1 is formed to be a spherical surface, it can be formed as a concave surface or a convex surface.

According to such configuration, the valve element contact surface 631*e*1 and the valve surface 636*a*1 are substantially in the state of face contact touched and adhesiveness between both is enhanced when the float valve 636 is located in an upper position. Accordingly, the sealability of oil at the drain hole 631*e* is enhanced. Therefore, seal of oil at the drain hole 631*e* can be satisfactorily performed particularly in warming up.

Figure 10:
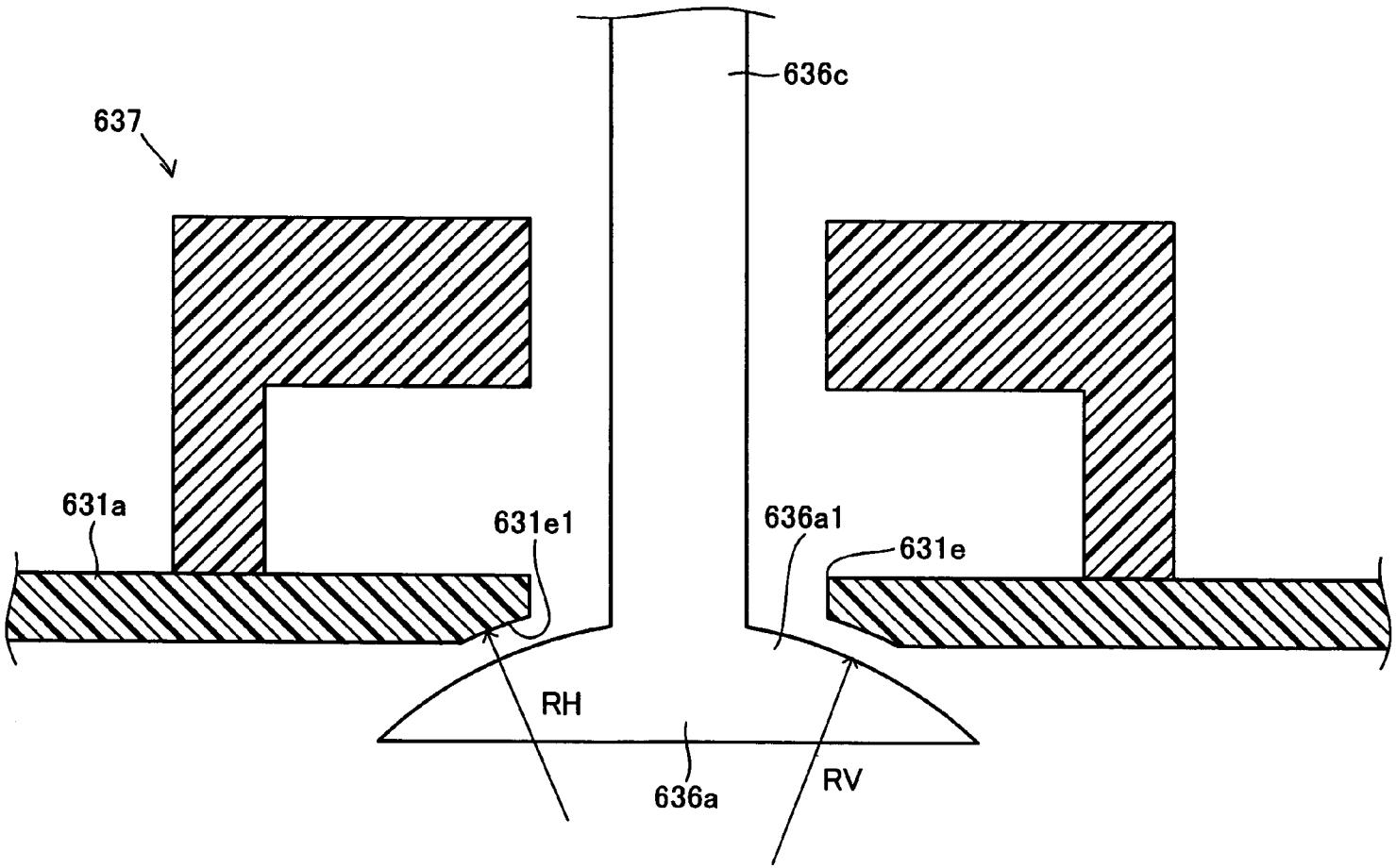
FIG. 10 is an enlarged sectional view showing the circumference of a drain hole shown in FIG. 9B.

FIG. 10 is an enlarged sectional view showing a circumference shown in FIG. 9B of the drain hole. As shown in FIG. 10, it is preferable that relation between a radius of curvature RH when the valve element contact surface 631*e*1 is formed as a concave curved surface (a concave spherical surface) and a radius of curvature Rv of the valve surface 636*a*1 is $Rv \leqq RH$.

When $Rv \approx RH$, the valve element contact surface 631*e*1 and the valve surface 636*a*1 respectively having the almost same curvature are touched in a wider range. Accordingly, the adhesion of both is further enhanced and the sealability of the drain hole 631*e* from oil is further enhanced.

In the meantime, when $Rv < RH$, small clearance between the valve element contact surface 631*e*1 and the valve surface 636*a*1 is formed. Hereby, even if the float valve 636 is inclined, the float valve 636 is smoothly rocked. Therefore, it can be effectively restrained that large clearance is made between the valve element contact surface 631*e*1 and the valve surface 636*a*1 and the sealability of oil at the drain hole 631*e* is greatly deteriorated when the float valve 636 is rocked. In this case, the width of the clearance between the valve element contact surface 631*e*1 and the valve surface 636*a*1 is widened toward the outside. And the inclination of the valve surface 636*a*1 is increased toward the outside. Accordingly, the accumulation and the fastening of foreign matters in the clearance are hardly caused.

Figure 11A:
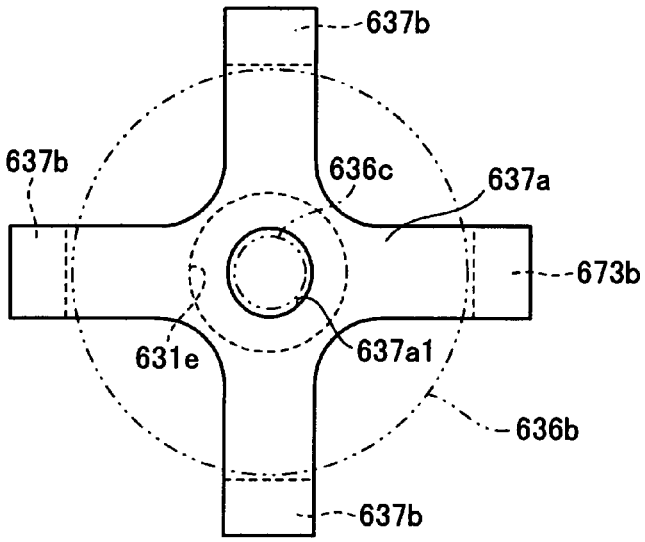
FIG. 11A is a plan.
Figure 11B:
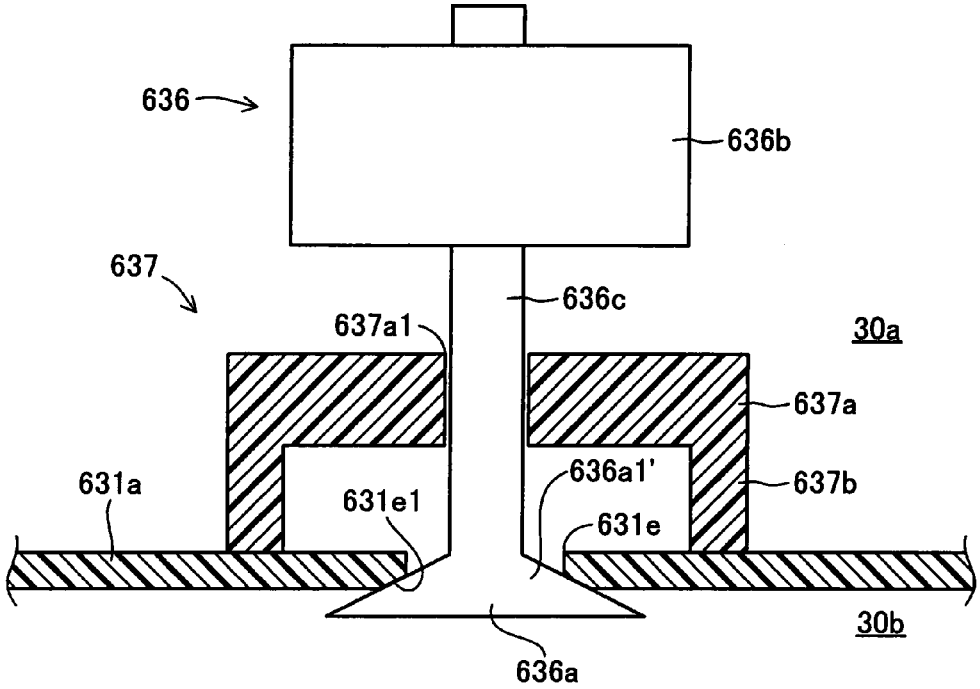
FIG. 11B is a side sectional view.

FIG. 11 show a modification of the configuration of the circumference of the float valve shown in FIG. 9, FIG. 11A is a plan, and FIG. 11B is a side sectional view.

As shown in FIG. 11, when a valve surface 636*a*1' is conical (or concave), clearance between a guide hole 637*a*1 formed piercing a guide part 637*a* of a float guide member 637 and an outside face of a coupling bar 636*c* can be set to a relatively small value (for example, approximately 1 to a few mm). Hereby, the inclination of a float valve 636 can be restrained. Therefore, it can be restrained that the limitation (the cutoff) of the communication of oil between a first chamber 30*a* and a second chamber 30*b* is greatly deteriorated by the inclination of the float valve 636.

FIG. 12 show another modification of the configuration of the circumference of the float valve shown in FIG. 9.

A float valve 736 in this modification is provided with the similar configuration to the above-mentioned float valve 636 (see FIG. 8 and others) and is configured by a valve element 736*a*, a float 736*b* and a coupling bar 736*c*. In this modification, the center of a lower surface 736*b*1 (a surface opposite to a float guide member 737 described later) of the float 736*b* is formed substantially conically and its circumference is flatly formed. That is, a convex portion is formed at a lower end of the float 736*b* by the lower surface 736*b*1 of the float 736*b*.

A valve surface 736*a*1 of the valve element 736*a* is formed to be a spherical surface convex outside.

The float guide member 737 in this modification is provided with the similar configuration to the above-mentioned float guide member 637 (see FIG. 8 and others) and is configured by a guide part 737*a* and legs 737*b*. The float guide member 737 (the guide part 737*a*) in this modification is configured so that it can cover most in a longitudinal direction of the coupling bar 736*c*.

An upper surface 737*a*2 of the float guide member 737 is formed in a shape following the lower surface 736*b*1 of the float 736*b*. That is, the center of the lower surface 736*b*1 of the float 736*b* is formed to be a concave conical surface (a conical inner surface) and its circumference is formed flatly. A concave portion is formed at an upper end of the float guide member 737 by the upper surface 737*a*2 of the float guide member 737.

Figure 12A:
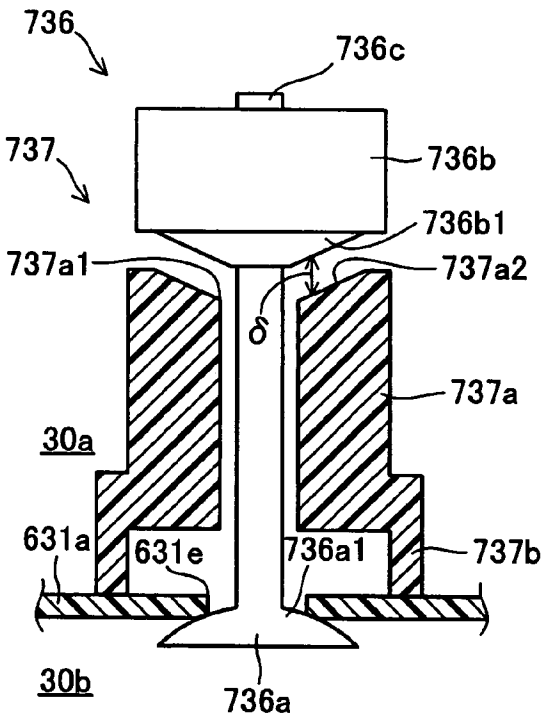
FIG. 12 show another modification of the configuration of the circumference of the float valve shown in FIG. 9.

Further, as shown in FIG. 12A, when the float valve 736 is located in an upper position, the lower surface 736*b*1 and the upper surface 737*a*2 are formed in parallel so that clearance δ between the lower surface 736*b*1 of the float 736*b* and the upper surface 737*a*2 of the float guide member 737 is constant. That is, in this modification, when oil is discharged as described above and when an oil level in a first chamber 30*a* rapidly lowers, a maximum value of quantity in which the float valve 736 is lowered is set to minimum lift quantity δ in which oil of required quantity can pass a drain hole 631*e*.

Figure 12B:
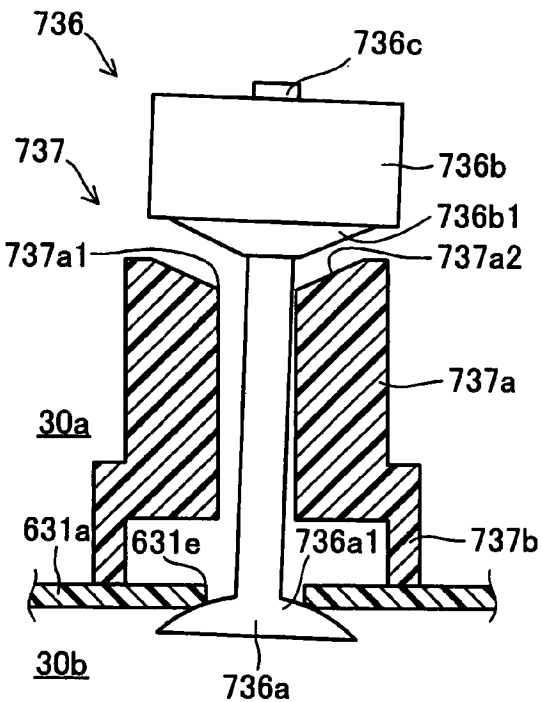

In such configuration, as shown in FIG. 12B, most in the longitudinal direction of the coupling bar 736*c* of the float valve 736 is surrounded by the float guide member 737 (the guide part 737*a*). Accordingly, the inclined quantity of the float valve 736 can be possibly limited.

As shown in FIG. 12B, even if the float valve 736 is inclined in the upper position, the satisfactory adhesiveness of the drain hole 631*e* and the valve surface 736*a*1 is maintained. Accordingly, the sealability of oil at the drain hole 631*e* can be satisfactorily maintained.

Figure 12C:
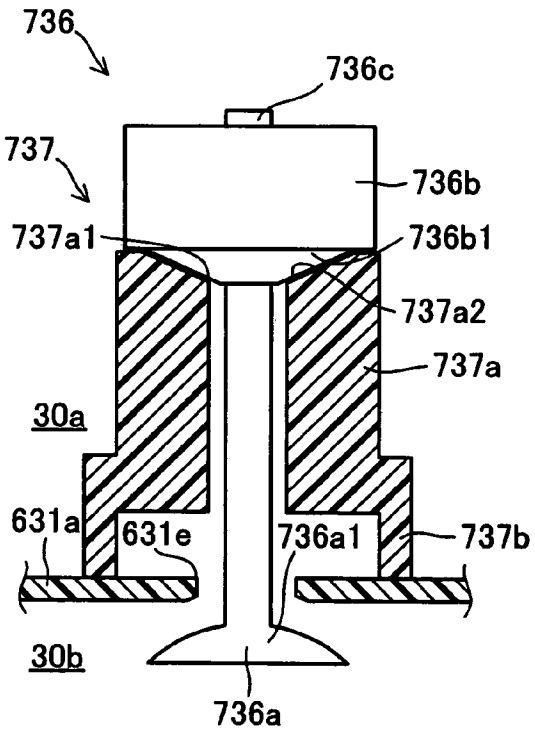

As shown in FIG. 12C, the above-mentioned convex portion formed at the lower end of the float 736*b* and the above-mentioned concave portion formed at the upper end of the float guide member 737 are fitted in a position in which the float valve 736 is lowered. As shown in FIGS. 12A and 12C, the moved quantity of the float valve 736 is set to a minimum value.

According to such configuration, when the float valve 736 is vertically moved, the inclination of the float valve 736 is reduced. Accordingly, vertical motion of the float valve 736 can be smoothly made. Therefore, as an oil level in the first chamber 30*a* rises, the float valve 736 is smoothly moved in the upper position and the drain hole 631*e* can be promptly and securely closed. Besides, as the oil level in the first chamber 30*a* lowers, the float valve 736 is smoothly moved in the lower position, the drain hole 631*e* is promptly and securely released, and predetermined quantity of oil can communicate between the first chamber 30*a* and a second chamber 30*b* via the drain hole 631*e*.

Figure 13A:
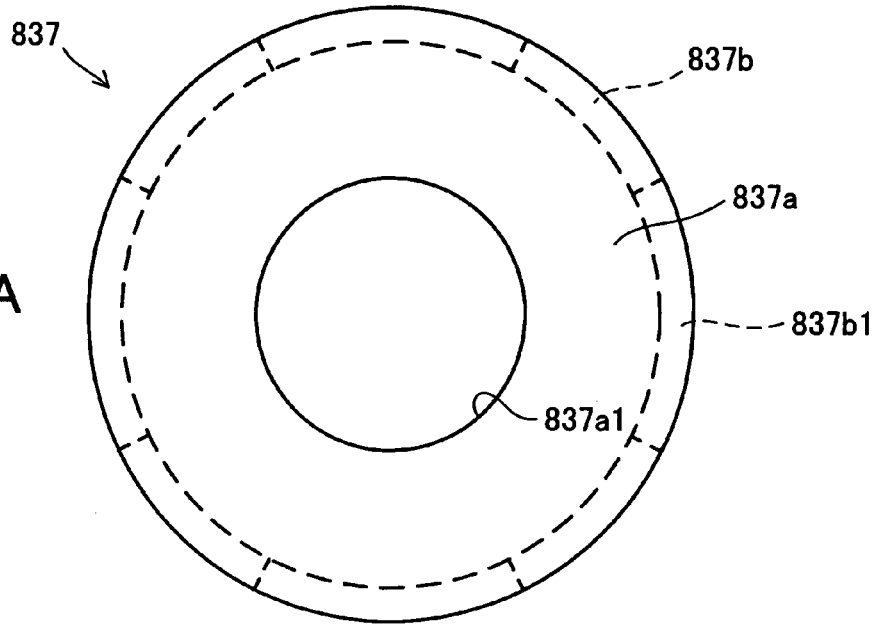
FIG. 13A is a plan.
Figure 13B:
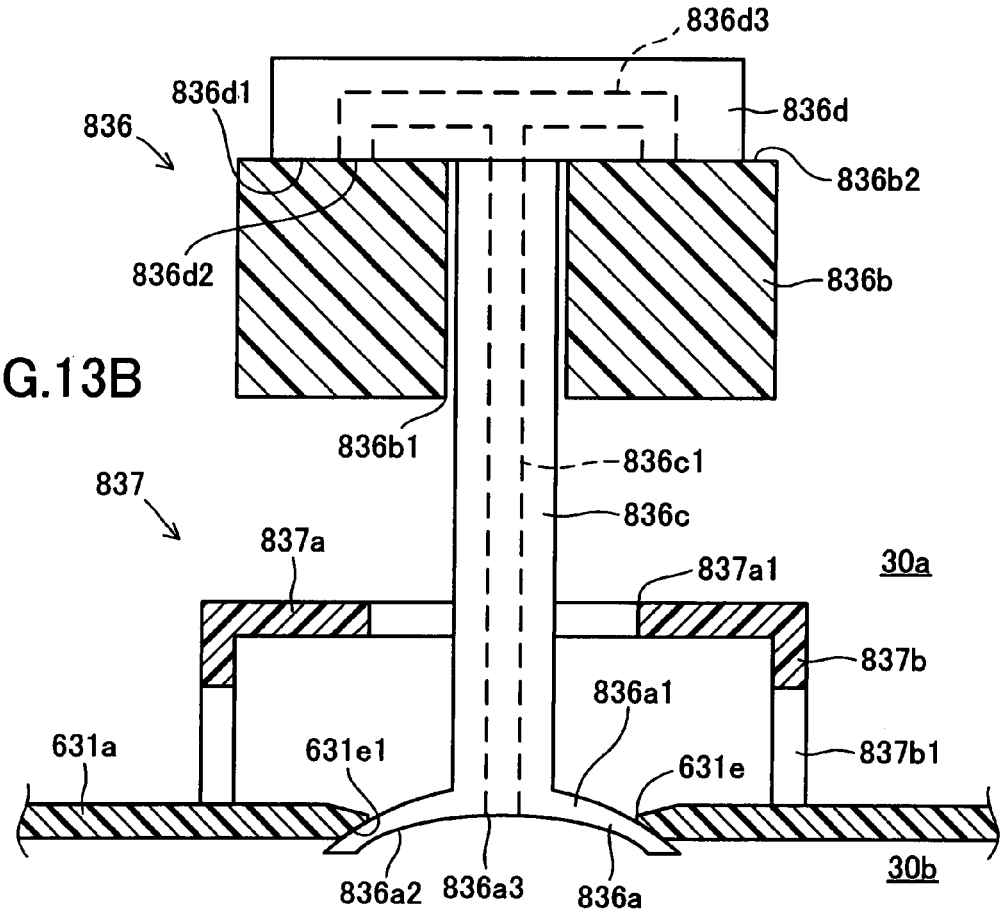
FIG. 13B is a side sectional view.

FIG. 13 show still another modification of the configuration of the circumference of the float valve shown in FIG. 9. In this modification, a float valve 836 and a float guide member 837 are provided. FIG. 13A is a plan showing the float guide member 837 and FIG. 13B is an enlarged side sectional view showing a circumference of a drain hole 631*e*. FIG. 14 are sectional views showing an operated condition of configuration shown in FIG. 13.

As shown in FIG. 13A, the float guide member 837 in this modification is configured by a disclike guide part 837*a* and cylindrical legs 837*b*. A guide hole 837*a*1 is formed in the center in a top view of the guide part 837*a* so that the float valve 836 is pierced. As shown in FIGS. 13A and 13B, plural openings 837*b*1 which are channels of oil are formed in the legs 837*b*.

As shown in FIG. 13B, the float valve 836 in this modification is configured by a valve element 836*a*, a float 836*b*, a stem member 836*c* and a float stopper member 836*d*.

The valve element 836*a* is formed so that the drain hole 631*e* can be closed from the side of a second chamber 30*b*. A valve upper surface 836*a*1 which is a surface opposite to the drain hole 631*e* of the valve element 836*a* is formed to be a spherical surface convex on the upside. A valve lower surface 836*a*2 which is a surface exposed to the side of the second chamber 30*b* of the valve element 836*a* is formed to be a concave surface.

The float 836*b* is provided with the similar configuration to the above-mentioned float 636*b* (see FIG. 8 and others). The float 836*b* in this modification is formed so that its contour is almost cylindrical.

In this modification, a float through hole 836*b*1 is formed piercing the float 836*b* along the central axis of the cylinder. The float through hole 836*b*1 is pierced by the stem member 836*c*. The float through hole 836*b*1 is formed so that predetermined clearance is made between its inner surface and an outer surface of the stem member 836*c*. That is, the float 836*b* is formed so that it can be relatively moved with the stem member 836*c* vertically in FIG. 13B.

A float upper surface 836*b*2 which is an upper surface (a surface on the reverse side to the surface opposite to the valve element 836*a*) of the float 836*b* is formed in a plane having satisfactory flatness.

The stem member 836*c* is integrated with the valve element 836*a* with it extended upward from the valve element 836*a* toward the first chamber 30*a*. The stem member 836*c* is formed so that it can guide vertical motion of the float 836*b* by piercing the float through hole 836*b*1 formed in the float 836*b* as described above via the predetermined clearance.

An oil channel in the stem 836*c*1 is formed inside the stem member 836*c*. The oil channel in the stem 836*c*1 is formed in a relative large diameter (for example, approximately 4 mm) so that low temperature oil having high viscosity before warming up is finished can pass. A second chamber-side opening 836*a*3 which is an end on the side of the second chamber 30*b* of the oil channel in the stem 836*c*1 is formed in the almost center of the valve lower surface 836*a*2 of the valve element 836*a*.

The float stopper member 836*d* is integrated with an upper end of the stem member 836*c*. A stopper lower surface 836*d*1 which is a lower surface (a surface opposite to the float 836*b*) of the float stopper member 836*d* is formed in a plane having satisfactory flatness. The float stopper member 836*d* can regulate the rise of the float 836*b* by touching the stopper lower surface 836*d*1 to the float upper surface 836*b*2 of the float 836*b*.

A first chamber-side opening 836*d*2 that can be open to the first chamber 30*a* is formed on the stopper lower surface 836*d*1. The first chamber-side opening 836*d*2 is an opening forming an end on the side of the first chamber 30*a* of an oil channel in the stopper 836*d*3 formed inside the float stopper member 836*d* and is formed so that the opening is opposite to the float upper surface 836*b*2 of the float 836*b*.

That is, an oil channel in the float valve including the oil channel in the stem 836*c*1 and the oil channel in the stopper 836*d*3 is formed so as to connect the second chamber-side opening 836*a*3 formed on the valve lower surface 836*a*2 which is the surface on the side of the second chamber 30*b* of the valve element 836*a* and the first chamber-side opening 836*d*2 formed on the stopper lower surface 836*d*1 of the float stopper member 836*d*.

Figure 14A:
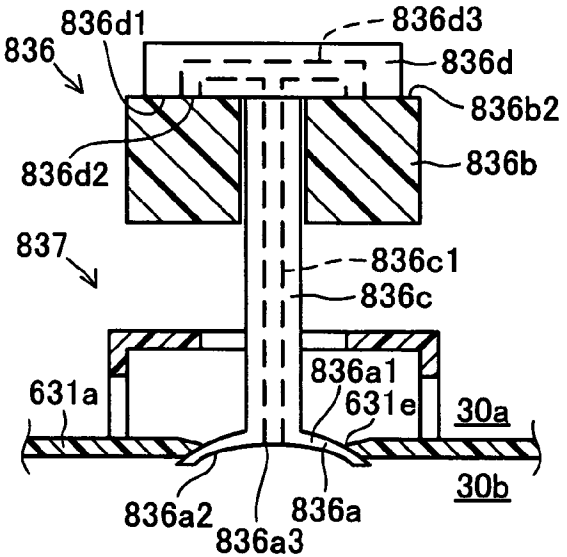
FIG. 14 are sectional views showing an operated condition of the configuration shown in FIG. 13.

In such configuration, when an oil level in the first chamber 30*a* is sufficiently high, the float 836*b* is lifted up to an upper position in which the float 836*b* is touched to the float stopper member 836*d* as shown in FIG. 14A. The float upper surface 836*b*2 which is the upper surface of the float 836*b* lifted up to the upper position is touched to the stopper lower surface 836*d*1 which is the lower surface on which the first chamber-side opening 836*d*2 is formed of the float stopper member 836*d*. Hereby, the first chamber-side opening 836*d*2 is closed by the float upper surface 836*b*2. Hereby, the communication of oil between the first chamber 30*a* and the second chamber 30*b* via the oil channel in the float valve is restrained (cut off).

Figure 14B:
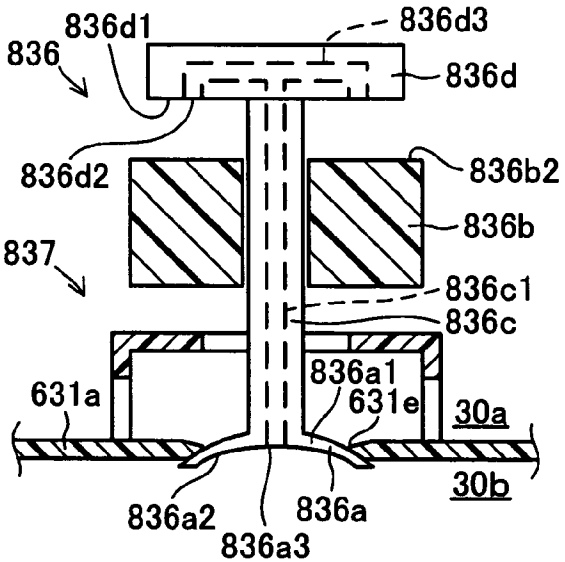

On the other hand, when an oil level in the first chamber 30*a* lowers, the float 836*b* lowers from the upper position as shown in FIG. 14B. At this time, the valve lower surface 836*a*2 which is a surface of the bottom of the valve element 836*a* is pressed upward by oil pressure in the second chamber 30*b* so that the drain hole 631*e* is closed. Accordingly, only the float 836*b* lowers in a state in which the valve element 836*a* closes the drain hole 631*e* (in a state in which the valve element 836*a*, the stem member 836*c* and the float stopper member 836*d* are located in the upper position).

At this time, the first chamber-side opening 836*d*2 closed by the float upper surface 836*b*2 is released. Then, the oil channel in the float valve between the second chamber-side opening 836*a*3 formed on the valve lower surface 836*a*2 at the bottom of the valve element 836*a* and the first chamber-side opening 836*d*2 is opened. Oil in the second chamber 30*b* flows from the second chamber-side opening 836*a*3 into the oil channel in the float valve by the oil pressure on the bottom of the valve element 836*a* and flows from the first chamber-side opening 836*d*2 forming an end on the side of the first chamber 30*a* of the oil channel in the float valve into the first chamber 30*a*.

According to such configuration, when an oil level in the first chamber 30*a* is extremely low in warming up (for example, when only little oil is stored immediately before low temperature starting), oil can be supplied from the second chamber 30*b* into the first chamber 30*a* via the oil channel in the float valve.

In this modification, the valve upper surface 836*a*1 which is the surface opposite to the drain hole 631*e* of the valve element 836*a* is also formed to be a spherical surface convex on the upside. Hereby, even if oil is moved in operation and the float valve 836 located in the upper position is inclined, the valve upper surface 836*a*1 is kept in satisfactory contact with the drain hole 631*e*. Accordingly, the ill-planned communication of oil between the first chamber 30*a* and the second chamber 30*b* via the drain hole 631*e* in operation (particularly in warming up) can be restrained.

Figure 14C:
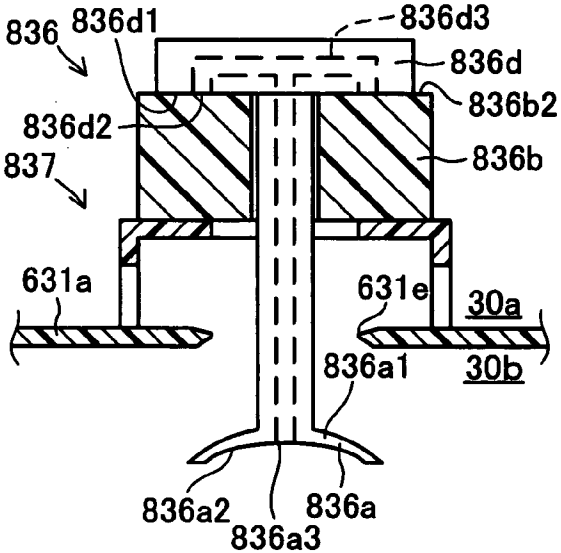

When an oil level in the first chamber 30*a* lowers further than the case of FIG. 14B and is the same or lower than the float guide member 837 in replacing the whole quantity of oil in the first chamber 30*a* and the second chamber 30*b*, the float 836*b* is laid on the flat guide part 837*a* of the float guide member 837 as shown in FIG. 14C. Then, as the oil pressure at the bottom of the valve element 836*a* decreases or disappears, the valve element 836*a*, the stem member 836*c* and the float stopper member 836*d* are moved to a lower position. Hereby, the drain hole 631*e* is fully released. Accordingly, residual oil in the first chamber 30*a* can be securely discharged on the side of the second chamber 30*b*.

In this modification, the float guide member 837 is also provided opposite to the stem member 836*c* of the float valve 836. Hereby, the inclination of the float valve 836 located in the upper position in operation can be restrained to some extent. When the whole quantity of oil in the first chamber 30*a* and the second chamber 30*b* is changed, vertical motion of the valve element 836*a*, the stem member 836*c* and the float stopper member 836*d* is guided. Hereby, the smooth vertical motion of the float valve 836 when the whole quantity of oil in the first chamber 30*a* and the second chamber 30*b* is changed is realized. Therefore, the float valve 836 is secured moved in the upper position shown in FIG. 14A by the rise of an oil level in the first chamber 30*a* and the satisfactory sealability of oil at the drain hole 631*e* is acquired. When the whole quantity of oil in the first chamber 30*a* and the second chamber 30*b* is discharged, the drain hole 631*e* is smoothly released and residual oil in the first chamber 30*a* can be securely discharged on the side of the second chamber 30*b*.

Spherical parts of the valve surfaces 636*a*1, 736*a*1, 836*a*1 of the float valves 636, 736, 836 shown in FIG. 8 and others may be formed in only a range in which each valve surface can be touched to the drain hole 631*e* in the upper positions of the float valves 636, 736, 836.

Needless to say, the above-mentioned embodiments and modifications may be suitably combined in a scope in which they do not mutually contradict technically.

What is claimed is:

1. An oil pan comprising:

a partition having a concave part forming a first chamber and partitioning the first chamber from a second chamber, the second chamber being adjacent to and below the first chamber, the first chamber communicating with an object lubricated by oil, the first chamber being configured to store oil;

an oil suction opening located inside the first chamber and connected to an oil pump, the oil pump being configured to deliver oil stored in the first chamber to the object;

a communicating opening which is a through hole provided at a bottom of the concave part of the partition equivalent to a lowest position of a bottom face of the first chamber and which is formed so that oil can be discharged downward from the first chamber into the second chamber when the oil is discharged outside from the second chamber; and a lid member arranged so that it can close the communicating opening from the outside and downside of the concave part, wherein the lid member is made of material having smaller specific gravity than oil.

2. An oil pan comprising:

a partition having a concave part forming a first chamber and partitioning the first chamber from a second chamber, the second chamber being adjacent to and below the first chamber, the first chamber communicating with an object lubricated by oil, the first chamber being configured to store oil;

an oil suction opening located inside the first chamber and connected to an oil pump, the oil pump being configured to deliver oil stored in the first chamber to the object;

a communicating opening which is a through hole provided at a bottom of the concave part of the partition;

a lid member configured to move according to an oil level and arranged so that the lid member can close the communicating opening from an outside of the concave part when the oil level is high;

a float member made of material having smaller specific gravity than oil and arranged inside the concave part opposite to the lid member with the communicating opening between the float member and the lid member;

a stem member integrated with the lid member so that the stem member is extended upward from the lid member toward an inside of the concave part and formed so that the stem member can guide vertical motion of the float member according to the oil level in the first chamber;

a rise regulating member integrated with an upper end of the stem member and formed so that the rise of the float member can be regulated by touching the rise regulating member to an upper surface of the float member and the lid member is configured to be lifted to touch the partition in order to close the communicating opening when the oil level is high; and an oil channel in a float valve provided piercing the lid member, the stem member and the rise regulating member so that the oil channel connects a second chamber-side opening formed on a surface on the side of the second chamber of the lid member with a first chamber-side opening formed on a lower surface touched to the upper surface of the float member of the rise regulating member.

3. The oil pan according to claim 2, wherein a surface opposite to the communicating opening of the lid member has a spherical part.

4. The oil pan according to claim 3, further comprising a guide member provided opposite to the stem member.

* * * * *